US007820565B2

(12) United States Patent
van Heerden et al.

(10) Patent No.: US 7,820,565 B2
(45) **Date of Patent: *Oct. 26, 2010**

(54) DENSELY WOVEN QUASI-UNIDIRECTIONAL FABRIC FOR BALLISTIC APPLICATIONS

(75) Inventors: Jason van Heerden, Dundas (CA); Shekoufeh Shahkarami, Ancaster (CA); David Verlin Cunningham, Newark, OH (US); Laura E. Pritchard, Cambridge (CA)

(73) Assignee: Barrday Inc., Cambridge, Ontario (CA)

( * ) Notice: Subject to any disclaimer, the term of this patent is extended or adjusted under 35 U.S.C. 154(b) by 985 days.

This patent is subject to a terminal disclaimer.

(21) Appl. No.: 11/545,115

(22) Filed: Oct. 5, 2006

(65) Prior Publication Data

US 2007/0099526 A1 May 3, 2007

Related U.S. Application Data

(63) Continuation-in-part of application No. 10/476,226, filed as application No. PCT/CA02/00655 on May 1, 2002, now abandoned.

(60) Provisional application No. 60/288,568, filed on May 3, 2001.

(51) Int. Cl.
*B32B 27/12* (2006.01)
*B32B 27/04* (2006.01)

(52) U.S. Cl. ..... 442/134; 442/135; 428/911

(58) Field of Classification Search ..... 442/134, 442/135; 428/911

See application file for complete search history.

(56) References Cited

U.S. PATENT DOCUMENTS

| | | | |
|---|---|---|---|
| 2,562,951 | A | 8/1951 | Rose et al. |
| 2,893,442 | A | 7/1959 | Genin |
| 3,105,372 | A | 10/1963 | Whitehead |
| 3,592,025 | A | 7/1971 | Sharpe |
| 3,819,461 | A | 6/1974 | Saffadi |
| 4,416,929 | A | 11/1983 | Krueger |
| 4,484,459 | A | 11/1984 | Hutson |
| 4,550,045 | A | 10/1985 | Hutson |
| 4,623,574 | A | 11/1986 | Harpell et al. |
| 4,681,792 | A | 7/1987 | Harpell et al. |
| 5,085,252 | A | 2/1992 | Mohamed et al. |

(Continued)

FOREIGN PATENT DOCUMENTS

| | | |
|---|---|---|
| EP | 07117677.0 | 1/2008 |

(Continued)

*Primary Examiner*—Ula C Ruddock
(74) *Attorney, Agent, or Firm*—Matthew A. Pequignot; Pequignot + Myers LLC

(57) ABSTRACT

A fabric including a first layer of high-performance unidirectional yarns and a second layer of high-performance unidirectional yarns disposed transversely to the first layer. The fabric also includes warp and fill encapsulating yarns woven around the unidirectional yarns to substantially stabilize the unidirectional yarns. The encapsulating yarns have tenacities and tensile moduli substantially less than the tenacities and tensile moduli of the unidirectional yarns. The fabric has a cover factor between approximately 0.75 and approximately 1.50.

23 Claims, 10 Drawing Sheets

U.S. PATENT DOCUMENTS

| | | | | |
|---|---|---|---|---|
| 5,091,245 | A | 2/1992 | Phillips | |
| 5,173,138 | A | 12/1992 | Blauch et al. | |
| 5,354,605 | A | 10/1994 | Lin et al. | |
| 5,437,905 | A | 8/1995 | Park | |
| 5,465,760 | A | 11/1995 | Mohamed et al. | |
| 5,545,455 | A | 8/1996 | Prevorsek et al. | |
| 5,591,933 | A | 1/1997 | Li et al. | |
| 5,635,288 | A | 6/1997 | Park | |
| 5,935,678 | A | 8/1999 | Park | |
| 5,958,804 | A * | 9/1999 | Brown et al. | 442/192 |
| 6,129,122 | A | 10/2000 | Bilisik | |
| 6,129,129 | A | 10/2000 | Chandezon et al. | |
| 6,562,435 | B1 * | 5/2003 | Brillhart, III et al. | 428/105 |
| 6,668,868 | B2 * | 12/2003 | Howland et al. | 139/383 R |
| 6,841,492 | B2 | 1/2005 | Bhatnagar et al. | |
| 2003/0228815 | A1 | 12/2003 | Bhatnagar et al. | |

FOREIGN PATENT DOCUMENTS

| | | |
|---|---|---|
| WO | WO 00/65297 | 11/2000 |
| WO | WO 02/090866 | 11/2002 |

* cited by examiner

DENSELY WOVEN QUASI-UNIDIRECTIONAL FABRIC FOR BALLISTIC APPLICATIONS

REFERENCE TO RELATED APPLICATION

This application is a continuation-in-part of application Ser. No. 10/476,226, filed on Jun. 3, 2004, now abandoned and hereby claims priority thereto and incorporates such application in its entirety by reference. Application Ser. No. 10/476,226 is the U.S. national stage filing of PCT Application No. PCT/CA02/00655, filed on May 1, 2002, which claims priority to U.S. Provisional Application No. 60/288,568, filed on May 3, 2001. This application hereby claims priority to all such applications and incorporates each in its entirety by reference.

FIELD OF THE INVENTION

This invention is related to densely woven quasi-unidirectional fabric for ballistic applications, and in particular, for use in composite materials having rigid matrices.

BACKGROUND TO THE INVENTION

Unidirectional fabrics are fabrics in which the warp and weft yarns are substantially parallel and in the plane of the fabric but without the over and under crimp of a woven structure. Without such an interwoven structure, the fabric of unidirectional yarn layers must be held together by some additional structure. Examples of additional structures include resin, film, stitching, knitted fabric and woven fabric.

Unidirectional fabrics have been fabricated for a long time. For instance, U.S. Pat. No. 2,893,442 (Genin), describes laying high modulus glass threads across each other without crimping them. The threads were loosely held together by weaving with much thinner and more flexible yarn. The resulting fabric was used as reinforcement in plastic laminates.

Unidirectional fabrics may be used as a reinforcing fabric by inserting a high modulus fiber in either the weft or warp direction of knitted fabrics as the knit fabric is being formed on the knitting machine, for example, as described in U.S. Pat. Nos. 3,105,372, 3,592,025 and 3,819,461. The resulting product has unidirectional fibers in the weft or warp direction, secured in place by the knit fabric. Such fabrics are currently in production and typically used in fiberglass reinforced plastic applications. A knit fabric with a ballistic yarn inserted in either the warp or fill direction of the fabric is also known.

A second type of unidirectional fabric is used in reinforcement of composites, for example, as described in U.S. Pat. Nos. 4,416,929, 4,550,045 and 4,484,459. These fabrics generally have two or three layers of unidirectional yarns with at least two of the layers being oriented at 90° to each other. Typically, two of the yarn layers are oriented either at 0/90° or at 45/45° to the longitudinal direction of the fabric. In the known fabrics, the yarns may then be stitched together, usually with stitch lines closely spaced together, for example, at a spacing of approximately on one-eighth inch (0.3 cm). The angle at which the layers of yarns are oriented to each other may be varied and the spacing of the stitching and the length of the individual stitches may also be varied. Such a fabric was marketed by Hexcel in the 1980's as a ballistic fabric. Such fabric has been produced with and without a thermoplastic film between the yarn layers. With the film between the layers, the fabric was hot pressed into hard (rigid) armor. The film melted during pressing and served as the resin system in the finished composite. Without the film, the fabric was used in soft armor applications, such as vests and blankets where flexibility of the fabric is required. It is understood that the material was not widely accepted in the ballistic market.

Another type of unidirectional fabric is composed of a large diameter high performance yarn in either the warp or fill direction and a lower strength, smaller diameter yarn as the opposing yarn. By keeping the tension high in the direction of the high performance fiber, coupled with the smaller size of the opposing yarn, the high performance fiber is substantially maintained in a straight line with only minimal over and under crimp. Such fabrics are used mainly in the sail cloth industry where the fabric is fabricated into sails with the high performance yarn oriented in the direction of the load on the sail and the weaker yarn provides stability in the off-axis direction. Such fabric is usually laminated to a polyester film, the film providing some stability in the bias direction of the fabric. This fabric is also used in ballistic applications with a thermoplastic film heat laminated to one side of the fabric, for example, as disclosed in U.S. Pat. Nos. 5,437,905, 5,635,288 and 5,935,678. In ballistic applications the fabric is further processed in a second step by being cross-plied i.e. one layer is placed at 90° to a second layer. The fabric is then heated and pressure is applied. The resulting two-layer fabric laminate is used in soft armor applications. Multiple layers of the material can be heat pressed to form a rigid armor laminate.

Another family of unidirectional fabrics was the subject of patents issued to Honeywell (formerly AlliedSignal), for example, U.S. Pat. Nos. 5,354,605, 5,173,138 and 4,623,574. These fabrics are produced by impregnating a unidirectional layer of filaments of high performance yarn with a thermoplastic resin system. Two layers of the resultant prepreg are cross-plied together at a 90 degree angle to form a single sheet of ballistic material. For soft armor applications, the cross-plied fabric has a thin thermoplastic film laminated to each side. For hard armor applications, the fabric is used without films and is heat laminated under pressure. These products are sold under a series of trademarks, including Spectra Shield, Spectra Flex, Spectra Shield Plus, Gold Flex, and Zyloshield.

Three dimensional fabrics may also be formed with two or more unidirectional high performance yarns oriented at 90° to each other and with a high performance fiber woven into the fabric, perpendicular to the unidirectional layers. The fabric looks and performs very similar to the closely stitched unidirectional fabrics discussed above. U.S. Pat. Nos. 5,465,760, 5,085,252, 6,129,122 and 5,091,245 are directed to such fabrics.

A typical plain woven fabric is shown in FIGS. 4A, 4B and 4C. As can be seen in FIGS. 4A, 4B and 4C, the yarns in the typical woven fabric are crimped because they are bent around each other.

The trend in the development of woven fabrics is to reduce the fabric crimp and spread the crossover points apart. This is accomplished by weaving yarn in a more open construction, usually retaining the plain weave construction. The individual yarns in the fabric must be flat and spread for an open construction for a ballistic fabric. Without flat, spread yarns, the interstices between the yarns become excessive and a bullet is able to slide through the resultant openings during impact, easily penetrating the layers of the armor. Improvements in yarn manufacture and weaving technology have allowed high performance yarns to be woven with little or no twist and with resulting flat, spread yarn orientation in the fabric. These lighter, more "open" fabric constructions result in more layers of fabric being required to meet specific ballistic specifications. The use of additional layers is believed to distribute the impact energy more evenly throughout the layers of fabric and hence is a benefit in and of itself. However, there is a limit to the openness of the weave that can be achieved with a standard woven fabric. As the openness increases, the fabric tends to become more of a mesh or scrim than a fabric, and such fabric has no merit or value in an armor application. In addition, the fabric becomes so flimsy that it can not be handled or cut without distorting the orientation of the yarns and ruining the fabric.

Appropriately designed unidirectional fabrics perform better in ballistic applications than woven fabrics. The weight of unidirectional fabric layers required to meet a ballistic specification is less than the weight of the layers of an equivalent woven fabric (i.e., a fabric made with the same denier of ballistic yarn, required to meet the same specification). It is to be understood that different denier yarns give different ballistic results in either standard woven or unidirectional fabrics. The total weight of the finished fabric layers is used for comparison and includes any film, resin or yarn required to stabilize the unidirectional yarns.

Typically, unidirectional ballistic fabrics have two or more unidirectional layers of yarn at 90° to each other. When more than two layers are used, the layers are alternated at 90° to each other. Such orientation has been achieved, for example, by laminating two unidirectional fabrics or prepreg layers together, with the top of one layer bonded to the bottom of an upper layer. This is done in a second operation using a film or resin as the adhesive layer. The 90 degree orientation is required for ballistic performance and the generally accepted standard for orientation is 90±5°. Woven fabrics by their nature have warp and fill yarns oriented at 90° (FIGS. 1, 4A, 4B, and 4C).

One reason for better performance of a unidirectional fabric (i.e., as compared to a woven fabric) is that the ballistic yarn is much less constrained in the unidirectional fabric. This allows the yarns to efficiently transmit energy away from the impact area along the length of the yarn, thereby maximizing the dissipation of energy. In contrast, woven fabrics constrain the individual yarns at the crossover points (FIGS. 1, 4A, 4B, and 4C). The constrained points reflect the tensile wave propagated along the yarns during the ballistic event. This reflected wave is cumulative with the initial strain wave, adding to the total tensile load acting on the yarn. The result is that the yarn is prematurely broken, before the maximum amount of energy can be absorbed along its length. The extent to which individual yarns in plain woven fabric are constrained is exacerbated upon impact of a projectile, because backward movement under impact of the projectile tightens the fabric. The constraint of the yarn in a unidirectional or quasi-unidirectional fabric, for example, may be minimized by the use of a low modulus film to adhere the two layers together or the use of a low strength, low tensile modulus yarn to hold the individual layers together.

Additionally, unidirectional fabrics offer better ballistic performance because, without the over and under crimp that is present in the yarns of a woven fabric (see FIGS. 4A, 4B, and 4C), the ballistic yarns in unidirectional fabrics immediately undergo tensile stress when impacted by a projectile. In contrast, yarn in woven fabric moves backward (i.e., generally in the projectile's direction of travel) when impacted by the projectile until the crimp is removed, and only then are the yarns in tensile stress. The backward movement of the fabric forms a depression and thus opens the weave of the fabric. The increased area of this depression reduces the number of yarns that can resist the projectile and decreases the total number of yarns directly involved in the ballistic event. Further, the cavity in the fabric formed by this backward movement limits the deformation of the projectile by constraining the sides of the projectile. This reduced area of the projectile has a further negative effect on the ballistic performance of the fabric system by restricting the number of yarns than can be behind the deformable projectile. Since the number of yarns behind the projectile is proportional to the square of the diameter of the projectile, deformation is a very important consideration in both fabric and vest designs where a deformable projectile is the threat. Further the deformable projectile absorbs energy in the deformation process. Lower deformation results in less energy being absorbed by the projectile per se.

The use of some unidirectional fabrics has resulted in significant decreases in the weight of some vest or armor systems. However, the cost of producing the known successful unidirectional fabrics is significantly more than that of a woven fabric. The increased cost is mainly due to the requirement that the individual layers of the fabric be produced in one weaving or prepreg operation and cross-plied in a second operation to produce a 0/90 construction.

Improvements in ballistic fabrics would be useful.

SUMMARY OF THE INVENTION

In its broad aspect, the invention provides a fabric including a first layer of high-performance unidirectional yarns and a second layer of high-performance unidirectional yarns disposed transversely to the first layer. The fabric also includes warp and fill encapsulating yarns woven around the unidirectional yarns to substantially stabilize the unidirectional yarns. The encapsulating yarns have tenacities and tensile moduli substantially less than the tenacities and tensile moduli of the unidirectional yarns. In addition, the fabric has a cover factor between approximately 0.75 and approximately 1.50.

In another aspect, the invention provides a single ply fabric including unidirectional ballistic resistant yarns in at least two layers in the single ply. The layers are at 90°±5° with respect to each other. The ballistic resistant yarns are substantially stabilized by being woven with encapsulating yarns having substantially lower tenacity and tensile modulus than the ballistic resistant yarns. Also, the fabric has a cover factor between approximately 0.75 and approximately 1.50.

In another aspect, the cover factor is between approximately 0.75 and approximately 1.25.

In yet another aspect, the ballistic yarn is a high performance ballistic resistant yarn.

In another of its aspects, the high performance ballistic yarn comprises dense glass fibers.

Also, in yet another of its aspects, the cover factor is approximately 0.89.

The invention also includes a composite material with multiple layers of the fabric of the invention.

In another of its aspects, the invention provides the composite material in which a thermoset resin has impregnated the fabric.

In yet another of its aspects, the encapsulating yarns have substantially deteriorated due to the process of forming the composite material.

In another aspect, the invention provides a fabric in which the high performance ballistic yarn comprises polymeric high performance yarn.

In another of its aspects, the polymeric high performance yarns have a linear density between approximately 400 denier and approximately 3000 denier.

In another aspect, the fabric has a cover factor between approximately 0.80 and approximately 1.05.

In yet another aspect, the ballistic resistant yarn is selected from the group consisting of glass yarn, polymeric high performance yarn, and basalt yarn.

In another of its aspects, the encapsulating yarns have a denier between approximately 20 and approximately 1000.

The invention additionally provides a method of forming a composite material. The first step is creating a single ply fabric comprising unidirectional dense glass ballistic resistant yarns in at least two layers in the single ply, the layers being at 90°±5° with respect to each other, the ballistic resistant yarns being substantially stabilized by being woven with encapsulating yarns having substantially lower tenacity and tensile modulus than the ballistic resistant yarns and the fabric having a cover factor between approximately 0.75 and approximately 1.25. Secondly, the method includes the step of creating a ballistic resistant fabric assembly comprising multiple layers of the single ply fabric. Next, the method involves immersing the ballistic resistant fabric assembly in a thermoset resin in liquid form. Next, the encapsulating yarns are permitted to substantially deteriorate due to the process of forming the composite material. Finally, the thermoset resin is cured.

Also, the invention provides a method of forming a composite material including the steps of, first, creating a single ply fabric comprising unidirectional aramid ballistic resistant yarns in at least two layers in the single ply, the layers being at 90°±5° with respect to each other, the ballistic resistant yarns being substantially stabilized by being woven with encapsulating yarns having substantially lower tenacity and tensile modulus than the ballistic resistant yarns and the fabric having a cover factor between approximately 0.80 and approximately 1.50. Second, a ballistic resistant fabric assembly comprising multiple layers of the single ply fabric is created. Next, the ballistic resistant fabric assembly is immersed in a liquid thermoset resin. Finally, the thermoset resin is cured.

In yet another aspect, the invention provides a fabric including a first layer of high performance unidirectional yarns and a second layer of high performance unidirectional yarns disposed transversely to the first layer. The fabric also includes warp and fill encapsulating yarns woven around the unidirectional yarns to substantially stabilize the unidirectional yarns. The encapsulating yarns have tenacities and tensile moduli substantially less than the tenacities and tensile moduli of the unidirectional yarns. Also, the fabric has a cover factor between approximately 0.40 and approximately 0.84.

BRIEF DESCRIPTION OF THE DRAWINGS

The present invention is illustrated by the drawings in which.

DETAILED DESCRIPTION

The present invention is directed to a fabric for ballistic applications. The fabric has unidirectional high performance ballistic-resistant warp and fill warns that are stabilized in a second woven fabric. Drawings of a plain weave fabric of the prior art and of a unidirectional fabric of the invention are shown in FIGS. 1 and 2.

Figure 1:
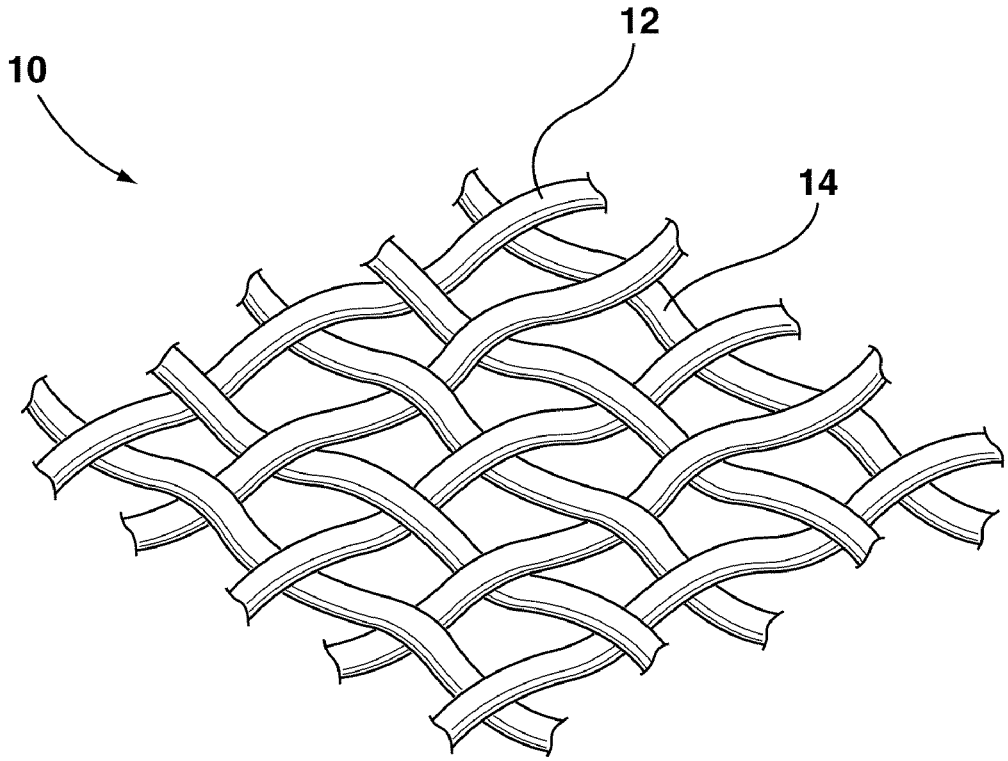
FIG. 1 is a representation of a plain weave fabric.
Figure 2:
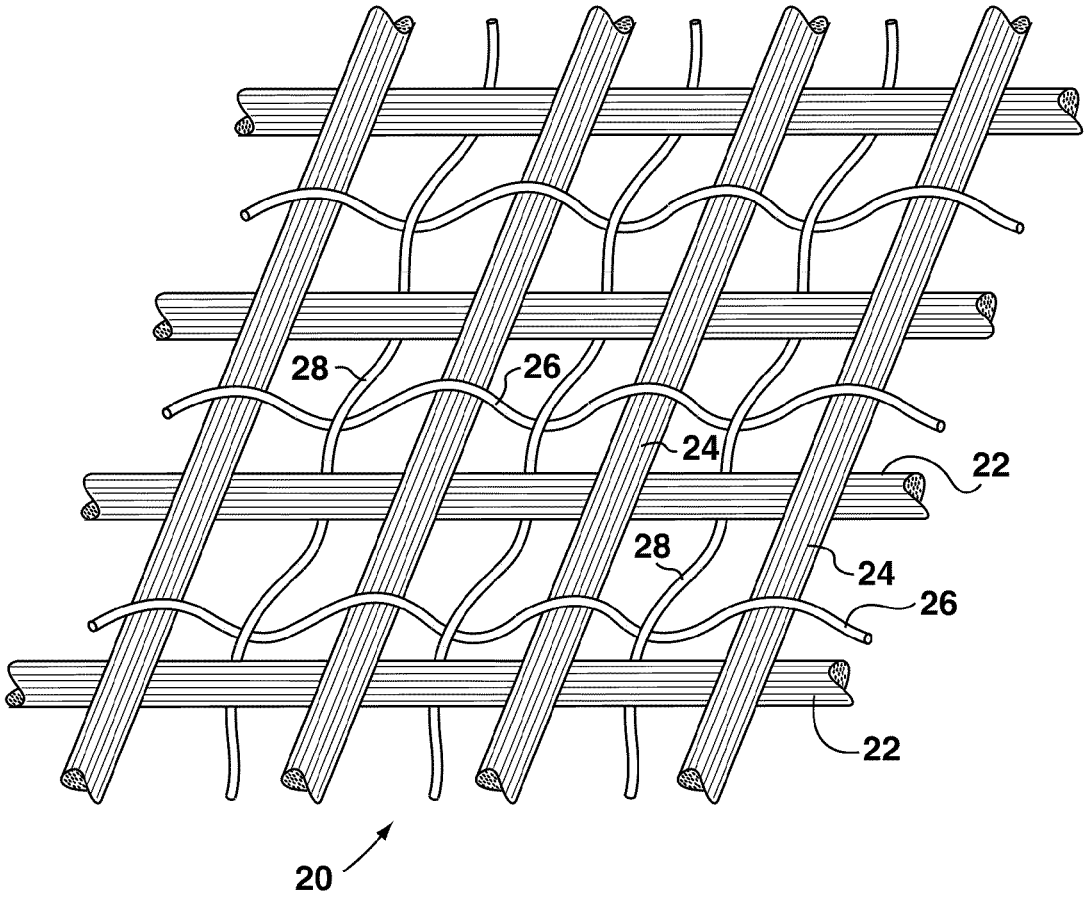
FIG. 2 is a representation of a quasi-unidirectional fabric of the present invention.

FIG. 1 shows a plain weave 10 having interwoven weft yarns 12 and warp yarns 14. FIG. 2 shows a so-called quasi-unidirectional fabric of the present invention, 20, having unidirectional warp and weft yarns 22 and 24 that are not woven or interlocked. Fabric 20 also has a second set of encapsulating yarns 26 and 28 which are woven similar to a plain weave to hold the fabric 20 together, as will be described.

The encapsulating yarns 26, 28 have significantly less tenacity and tensile modulus and, preferably, a smaller size. The denier of the second yarn may range from about 20 denier, or less, to about 1000 denier, depending on the size of the ballistic-resistant yarns 22, 24. The fabric of the invention has ballistic-resistant, unidirectional warp and fill yarns and does not have a requirement to be cross plied as in previous processes for the production of unidirectional ballistic resistant fabric.

The fabric of the present application does not require a cross-ply operation as two unidirectional layers are created during the weaving operation, oriented at about 90° with respect to each other. Further, the unidirectional yarns in the fabric generally are not substantially constrained since the stabilizing encapsulating yarn is a low strength, low modulus yarn that readily breaks during a ballistic event.

The fabric of the present application has two unidirectional yarn layers at about 90° to one another, stabilized by encapsulating yarns. Such a fabric may be woven on standard weaving looms, including rapier, shuttle, air jet and water jet looms. It may also be produced on knitting machines of the type described in the aforementioned U.S. Pat. Nos. 3,592, 025 and 3,819,461, on a three dimensional weaving machines of the type described in U.S. Pat. Nos. 5,465,760, 5,085,252, 6,129,122 and 5,091,245 or on equipment designed to produce two or more unidirectional layers held together by stitching, as described in U.S. Pat. Nos. 4,416,929, 4,550,045 and 4,484,459.

The fabrics of the invention have ballistic resistant, unidirectional warp and fill yarns, which are not cross plied, in contrast to previous unidirectional ballistic resistant fabrics.

Ballistic resistant yarns are defined as those yarns having tenacity of about 15 grams per denier and higher, and tensile modulus of at least about 400 grams per denier. Examples are aramid fibers, extended chain polyethylene fibers poly(p-phenylene-2,6-benzobisoxazole) (PBO) fibers and glass fibers. Aramid and copolymer aramid fibers are produced commercially by DuPont, Twaron Products and Teijin under the trade names Kevlar®, Twaron®, and Technora®), respectively. Extended chain polyethylene fibers are produced commercially by Honeywell, DSM, and Mitsui under the trade names Spectra®, Dyneema®, and Tekmilon®, respectively. An extended chain polyethylene fiber produced in China has been marketed under the description of High-intensity & High-modulus polyethylene fiber. Polyethylene fibers and films were produced by Synthetic Industries and sold under the trade name Tensylon®. Poly (p-phenylene-2,6-benzo-bisoxa-zole) (PBO) is produced by Toyobo under the commercial name Zylon®). Liquid crystal polymers were produced by Celanese under the trade name Vectran®. Other ballistic yarns may be used.

The encapsulating yarn woven with the ballistic resistant yarn (i.e., the unidirectional yarns) is of significantly smaller denier than the unidirectional yarns or is a yarn having significantly less tenacity and tensile modulus. The determination of the properties of this stabilizing yarn involved many trials. From these repeated trial fabrics and their ballistic results come the parameters that can be used to weave a quasi-unidirectional fabric that has superior ballistic resistant properties.

The diameter of the encapsulating yarn in the preferred construction, namely a plain weave construction with the encapsulating yarn and the ballistic yarn alternating, has a minor effect on the crimp of the yarn as long as the modulus and strength parameters meet the requirements that are listed later. The crimp in the yarn is the same when the encapsulating yarn diameter is about 2.5% of the ballistic yarn diameter as it is when the diameter of the encapsulating yarn is about 10% of the diameter of the ballistic yarn. The relative diameter of the nylon yarn to the ballistic yarn used in the quasi-unidirectional fabric may be as high as about 14% and still produce a fabric that would test equivalent to the best homogeneous fabric woven from the same ballistic yarn.

Figure 3:
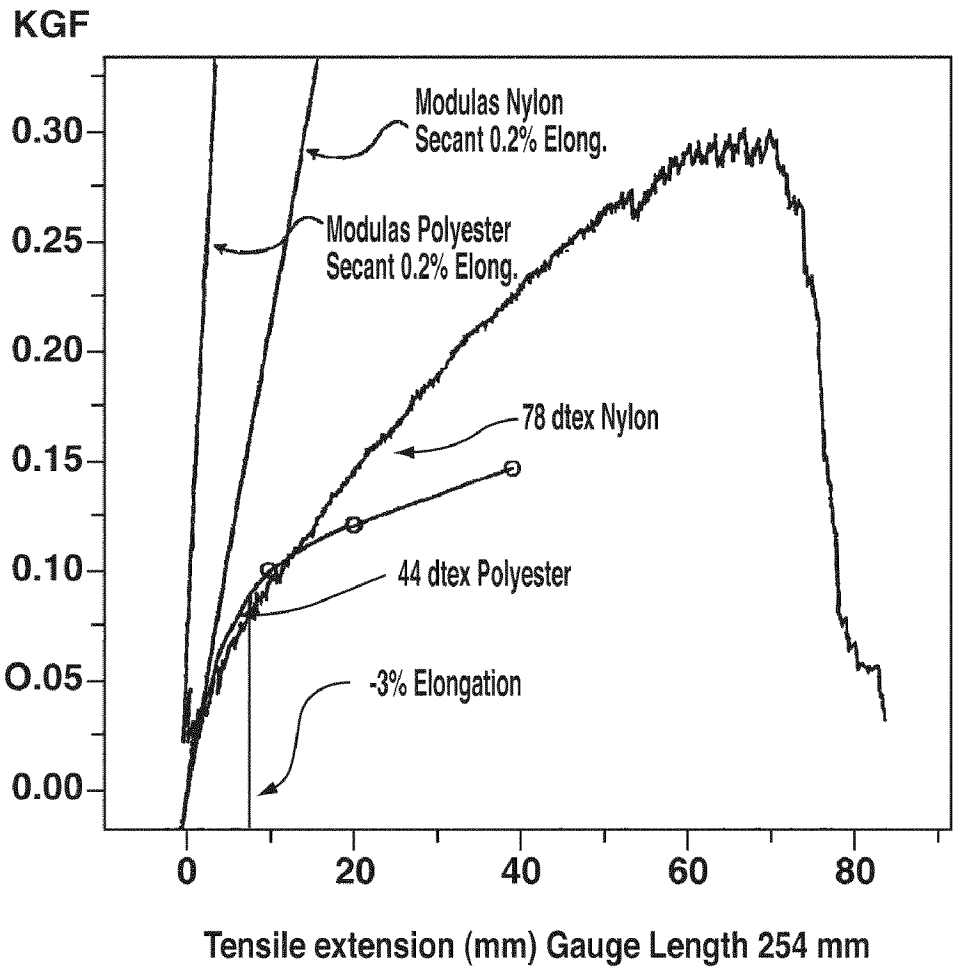
FIG. 3 is a stress-strain curve as described below.

The total strength of the encapsulating yarn and its tensile modulus must be controlled for the resulting fabric construction to have ballistic performance that exceeds that of a standard ballistic fabric woven from the same size of ballistic yarn. The stress waves propagating down the length of the ballistic yarn from the impact of the thread are reflected at the crossovers of the encapsulating yarn in the same manner that the waves are reflected at the crossovers of the ballistic yarn in the standard weave. The magnitude of the reflected wave is directly proportional to the restraining force the encapsulating yarn exerts on the ballistic yarn. The magnitude and duration of that force is a function of the total strength of the encapsulating yarn and its tensile modulus. The area of the stress/strain curve (FIG. 3) of interest is no more than the initial about 3.5% of the elongation. At about 3.5% the ballistic yarn has failed and the fabric structure has been destroyed at the impact site. FIG. 3 shows the stress-strain curves for two fibers, namely a 78 dtex nylon and a 44 dtex polyester.

Quasi-unidirectional fabrics were woven with different size encapsulating yarns until a fabric was woven with ballistic resistance that equalled those of the standard woven ballistic fabric of the same construction. The fabric was woven with 40 denier polyester yarn as the encapsulating yarn and an 840 denier aramid yarn as the ballistic yarn. The same fabric construction was also woven using 70 denier nylon yarn as the encapsulating yarn. The fabric woven with the 40 denier polyester yarn tested similar to a standard woven fabric but the fabric woven with the larger denier nylon had much better ballistic properties.

The tensile properties of the polyester yarn were measured, compared to the ballistic yarn properties and are considered the maximum tensile properties that an encapsulating yarn can possess, when the properties are expressed as a percentage of the ballistic yarn property. The secant modulus at 0.2% elongation of the 40 denier polyester was 1777 grams force per tex while the total strength of the yarn at 3% elongation was 88 grams or 0.40% of the break strength of the aramid yarn. The secant modulus at 0.2% elongation of the 70 denier polyester was 966 grams force per tex while the total strength of the yarn at 3% elongation was 83 grams or 0.38% of the break strength of the aramid yarn. For all yarns providing the encapsulating yarn, the maximum tensile properties are provided by a secant modulus at 0.2% elongation of 1777 grams force per tex and/or the total strength of the yarn at 3% elongation of 0.4% of the break strength of the yarn.

The stabilizing fibers, which may be referred to as encapsulating yarns, may be selected from a wide range of the fibers. Such fibers include natural fibers such as cotton, wool, sisal, linen, jute and silk. The fibers also include manmade fibers and filaments such as regenerated cellulose, rayon, polynosic rayon and cellulose esters. The fibers further include synthetic fibers and filaments, such as acrylics, for example, polyacrylonitrile, modacrylics such as acrylonitrile-vinyl chloride copolymers, polyamides, for example, polyhexamethylene adipamide (nylon 66), polycaproamide (nylon 6), polyundecanoamide (nylon 11), polyolefin, for example, polyethylene and polypropylene, polyester, for example, polyethylene terephthalate, rubber and synthetic rubber and saran. Glass fiber may also be used. Staple yarns may also be used and may include any of the above fibers, low denier, staple ballistic yarns or any combination of these yarns. The staple yarns are used particularly where the base properties of the continuous filament yarns exceed the maximum allowable properties required in a quasi-unidirectional fabric. Staple yarns, by the discontinuous nature of their filaments that form the yarn, have much lower tensile and modulus properties than those yarns composed of continuous filament. Denier can range from a low of about 20 denier, or less, to about 1000 denier, depending on the size of the ballistic-resistant fibers.

The performance of the final fabric is particularly related to the function of the encapsulating yarn properties. It is desirable that the encapsulating yarn is of a denier that is as low as practical to weave. It is also desirable that the elongation be as high as possible, while the tensile modulus and break strength should be as low as possible. The above properties of the encapsulating yarn result in ballistic fabrics. As the properties increase or decrease as noted above, the ballistic performance of the final fabric improves.

When the fabric of this invention is woven on a weaving machine, the fabric has two or more warp yarns and two or more fill yarns. The unidirectional warp yarns and fill yarns are ballistic resistant yarns. The second warp and fill yarn are the low denier, lower strength yarns, i.e., encapsulating yarns. The lower strength yarns are woven together with the unidirectional yarns to hold and stabilize the unidirectional yarns. The weave could be as simple as a plain weave where the low strength yarn is alternated with the ballistic yarn in both the fill and warp. The resulting fabric has the unidirectional ballistic resistant yarns encapsulated in the fabric woven from the low strength yarn. The high performance yarns do not cross over each other in an over and under construction in this fabric but instead lie in a unidirectional layer oriented at 90° to each other, without crimp. The lower strength yarn has a woven, over and under, construction and encapsulates and stabilizes the ballistic resistant yarn. The low denier, fill yarn holds the warp of the unidirectional yarn in place while the low denier, warp yarns hold the unidirectional fill yarns in place. The total crimp in this fabric is large but is entirely taken up in the low strength (encapsulating) yarns.

As shown in FIG. 2, the preferred construction of the quasi-unidirectional fabric involves two unidirectional layers oriented at about 90° with respect to each other. Preferably, the fabric of the invention is a plain weave with the encapsulating yarn and the ballistic yarn alternating. Correctly constructed the ballistic yarns of the fabric have less than about 1% crimp. The number of yarns per inch is critical to the performance of the fabric, particularly when the fabric is used in a flexible vest without the addition of resin. Some minimal tension is required in the encapsulating yarn to weave the fabric. This tension, if allowed to remain in the fabric, is sufficient to destroy the ballistic properties of the fabric. Preferably, the construction is open enough to allow the tension in the encapsulating yarn to shrink the fabric and to dissipate the residual tension from the weaving operation.

The pick count of the quasi-unidirectional fabric of the invention used in an application without a resin can be calculated from the maximum tightness that can be woven in a plain weave fabric of 100% ballistic yarn. The yarn count in ballistic yarns per inch should be about 50% of this value plus or minus two picks for optimal ballistics. The weave can vary from this count but the ballistic properties will decrease.

Quasi-unidirectional fabrics used in hard armor systems with various resin systems are less sensitive to residual stress in the encapsulating yarn since constraint of the ballistic yarn imposed by the resin system exceeds the constraint imposed by the encapsulating yarn. Constructions with yarn counts up to 84% of the maximum may be used.

In general, the yarn count of the ballistic yarn per inch is about 40 to about 85% of the maximum tightness that can be woven in a plain weave fabric composed entirely of the same ballistic yarns.

Another way of measuring the spacing of the fibers from each other is "cover factor". Cover factor is defined as the ratio of threads per inch to the theoretical maximum. The cover factor of any given fabric is a function of the yarn's specific gravity and the linear density of the yarn. A fabric with a cover factor of 1.00 represents the theoretical maximum number of yarns per unit of area that can be woven into a plain woven fabric.

The weave pattern of the low strength yarns may also be a twill pattern, a basket weave pattern, a satin weave or any other weave pattern. The different weave patterns allow the number of unidirectional warp and fill yarns that are encapsulated in each opening of the low strength yarn weave to vary. The weave patterns also determine the frequency that the low denier yarns are interlocked. By varying the weave pattern, fabric construction advantages such as reduced yarn bundling may be achieved.

The number of low strength yarns may be varied in both the warp and fill direction, which provides variety to the final fabric in terms of number of low strength yarns per ballistic yarns and the number of ballistic yarns that are encapsulated in each opening of the weave.

The total number of low strength yarns and the frequency of interlocking are important factors in determining the stiffness of the quasi-unidirectional fabric of the present invention. Fabrics with a higher proportion of low strength yarns and a larger number of interlocks tend to be stiffer and have more constrained ballistic yarns. While the generally accepted theory is that a stiffer fabric will have a lower ballistic resistance, it is expected that the fabric will transmit less trauma to the body during a ballistic event. Thus, design of vests for ballistic end-uses becomes a task of balancing of the proportion of stiffer fabric with more flexible fabric to produce an optimum vest design. As a general guideline, the stiffer fabrics would be used behind the more flexible fabric, but the opposite construction may be preferred in some instances. It is to be understood that there are a large number of quasi-unidirectional fabrics that can be woven in the manner of this invention, each with a different set of properties. Consequently, the number of combinations of quasi-unidirectional fabrics for vest design may be large. Different combinations may be preferred for different applications.

It is desirable to minimize the weight of the low strength yarns as a percent of the total fabric weight since this yarn is not involved in the ballistic event. However, an increased amount of low strength yarn results in a more durable, stable fabric but the fabric weight is heavier and will have reduced ballistic properties due to increased constraint of the unidirectional yarns by the stabilizing fabric. The lowest denier, lowest strength yarn that can be woven and satisfies all of the requirements for a particular application is the preferred yarn. The denier of the yarn may vary with the application.

In embodiments of the invention, it has been found that 78 dtex nylon yarn, when woven in a plain weave construction and alternated with a 1330 dtex Spectra® yarn, provides sufficient stability and durability to the fabric for it to be used in a soft ballistic vest with the confidence that the fabric would be stable for a minimum five year life of the vest. This fabric exhibits an increase of 22 to 30% when the ballistic performance of a pressed panel is compared to the same weight panel made from the standard woven 1330 dtex Spectra® fabric. In other embodiments, it has been found that the fabric performs better when it is woven at decreased pick count from the standard woven fabric made from the same ballistic yarn. In other embodiments, it has been further found that a decrease in yarn count below a given count does not result in increased ballistic performance.

In general, fabrics woven from finer denier ballistic yarns perform better than fabrics woven from larger diameter ballistic yarns, with the former being more expensive. It is believed that fabrics may be woven from each of the various deniers of ballistic yarns that are available commercially. The stabilizing yarn may vary with each denier of ballistic yarn. For each type and denier of ballistic yarn, it is anticipated that there will be an optimum weave fabric for soft armor applications based on the $V_{50}$ performance. The $V_{50}$ performance of a fabric target is the velocity at which 50% of a given type of projectile, when striking the fabric target, will completely penetrate the target.

Fabric woven according to the present invention using polyethylene yarns may be processed using high pressure methods used to process existing polyethylene products. For example, it is anticipated that the quasi-unidirectional fabric of the present invention, when pressed at pressures in the 3000 to 4000 pounds per square inch range, will exhibit increased ballistic performance. It is also anticipated that corona treatment of the polyethylene yarns before coating with a resin system will increase the adhesion and ballistic performance of the resulting composite.

The fabric provided herein may be sold as is or it may be further processed. For hard armor applications, the fabric may be fabricated into a prepreg using either a film or a wet resin. The film or resin may be applied to one side of the fabric or the fabric may be totally impregnated with the resin or the film may be worked into the fabric. The film or resin may be a thermoplastic or a thermoset resin. Any resin or film that can be used to create a ballistic prepreg can be used with this fabric. Two layers of this fabric may also be laminated together to create a double layer fabric.

The fabric may have a film adhered to the surface with an adhesive. The film provides more stability to the fabric and provides a wear surface to the fabric. This structure may be used for a vest where a high level of abuse would exist. The film-laminated fabric would also produce a stiffer fabric that could be used to control the energy transmitted through the vest. The film would preferably be a thin polyethylene film but could be any film that could be adhered to the fabric.

If the fabric is made on an insertion knitting machine, the inserted unidirectional yarns would be ballistic resistant fibers while the knitted yarn that encapsulates the high performance fibers would be the lower strength/diameter yarn. The low denier, lower strength yarns serve the same purpose as they do in the woven fabric, i.e. encapsulate and stabilize the ballistic yarn while not unduly constraining the yarns. These stabilizing yarns must meet the maximum strength and modulus requirements listed previously, that is, the secant modulus at 0.2% elongation must be 1777 grams force per tex or less and the total strength of the yarn at 3% elongation must be 0.40% of the break strength of the aramid yarn. The knitted fabric may perform as a ballistic fabric if either of the criterion are met. It is possible in this process to insert both a unidirectional warp and a fill simultaneously. In this case, cross-plying of the fabric for ballistic applications would not be required. If only one ballistic yarn is inserted, either in the warp or fill direction, then the fabric must be cross-plied to form a ballistic fabric or article. The knitted fabric may be fabricated into a prepreg, laminated together or film faced as the woven fabric previously described.

If the fabric is made on a three dimensional weaving machine, the warp and fill yarns are ballistic yarns while the yarn woven perpendicularly is a low strength, low denier yarn. The low denier, lower strength yarns serve the same purpose as they do in the woven fabric i.e. encapsulate and stabilize the ballistic yarn while not unduly constraining the yarns. These stabilizing yarns must meet the strength and modulus requirements listed previously, that is, the secant modulus at 0.2% elongation must be 1777 grams force per tex or less and the total strength of the yarn at 3% elongation must be 0.40% of the break strength of the aramid yarn. The woven fabric may perform as a ballistic fabric if either of the criterion are met. The three dimensional fabric can be fabricated into a prepreg, laminated together or film faced as the woven fabric previously described.

If this fabric is manufactured as two unidirectional yarns sewn together, the unidirectional yarns are the ballistic resistant yarns while the sewing thread is the lower strength yarn. These sewing threads must meet the strength and modulus requirements listed previously, that is, the secant modulus at 0.2% elongation must be 1777 grams force per tex or less and the total strength of the yarn at 3% elongation must be 0.40% of the break strength of the aramid yarn. The woven fabric may perform as a ballistic fabric if either of the criterion are met. The fabric will not have to be cross-plied in this form. The sewn fabric may be fabricated into a prepreg, laminated together or film faced as the woven fabric previously described.

This invention is specifically designed to produce a quasi-unidirectional fabric for ballistic resistant armor applications. The fabric may be used by itself or in combination with various other ballistic fabrics and materials to produce flexible armor. Such other ballistic fabrics may include woven ballistic fabrics made of aramid, polyethylene, poly(p-phenylene-2,6-benzobisoxazole) (PBO) fibers or glass fibers. The other fabrics may include various unidirectional products based on known unidirectional technology where the ballistic fiber is aramid, polyethylene or poly(p-phenylene-2,6-benzobisoxazole) (PBO). The fabric of this invention may be used in any combination with the materials above and may replace any one material or combination of materials in an existing vest design. In addition, the fabric of this invention can be laminated together or laminated with films to produce fabric to further reduce the trauma transmitted through an armor system. Alternately, the laminated fabric may be used in a vest where the stiffer laminated fabric replaces a more flexible fabric. The flexible fabric in this instance would be sewn extensively while the laminated fabric may be used with or without stitching.

The proportions of each material and the total weight of the armor may vary depending on the ballistic threat, i.e., particular specifications for ballistic vests or armor. Similarly, the proportions of the materials and the total weight of the armor may vary depending on how much extra material an armor fabricator will use in an armor design to assure that the armor passes a ballistic test in a repeatable manner.

In rigid armor applications, the fabric of this invention may be used with various resin systems to produce a rigid panel. This rigid panel can be used as armor by itself or in combination with other rigid panels made from aramid, polyethylene, poly(p-phenylene-2,6-benzobisoxazole) (PBO) fibers, or glass fibers. These panels or combinations of panels can be used in an armor system backed by ballistic fabric. Alternately, panels made from the fabric of this invention alone or in combination with the above mentioned armor panels may act as a backer behind ceramic or metallic plates to form a composite armor system. Many variations and modifications may be made to the above mentioned armor samples. In particular, the new fabric design of the present invention may be used in armor articles, the general design of which is recognized. While the exact number of layers of fabric and the exact weights of the combinations of materials is unknown, it may be readily ascertained for a particular specification of properties by the ballistic testing of the materials. This testing is routinely completed by those conversant in the art of armor design.

Additional applications for this fabric include in sailcloth where it is desirous of have no crimp or stretch in either one or both directions in the fabric and in composite applications where it is also desirous to have no crimp in the reinforcing yarn. In the sailcloth application, polyester yarn would be the preferred encapsulating yarn since it would adhere to the Mylar® film used in high performance sails. In the composite application, the encapsulating yarn would most preferably be a small flexible glass yarn.

The present invention is illustrated by the following Examples.

EXAMPLE I

An experimental fabric was made with 1330 dtex (i.e., 1,200 denier) Spectra® (extended chain polyethylene) warp and fill yarns and 78 dtex nylon warp and fill yarns. The Spectra® yarn was twisted while the nylon yarn was not twisted. The Spectra® yarn was fed into the loom from one beam while the nylon was fed from a second beam.

The different warp yarns were alternated in the fabric, i.e. a Spectra® yarn followed by a nylon yarn, repeated across the fabric. The fill yarn was also alternately Spectra® and nylon. The fabric was woven as a plain weave fabric. To reflect the difference in strength, modulus and diameter, the Spectra yarns were unidirectional while the nylon yarns formed a crimped fabric supporting the Spectra yarns. The count of the fabric was 21 Spectra per inch and 21 nylon yarns per Inch in both the warp and fill direction. The maximum number of 1200 denier yarns that can be woven into a plain weave is 25 ends per inch. The ratio of the diameter of the encapsulating yarn to the ballistic yarn was 5.4%. (The cover factor for the fabric was approximately 1.04.) The finished fabric was coated with a thermoplastic elastomer (Barrday elastomer 015671), 20% by weight, to form a prepreg. Thirteen layers of this prepreg were pressed at 250° F. (121° C.). and 230 psi for 30 minutes. The panel was cooled under pressure to 200° F. (93° C.). before the pressure was released. The resultant panel was immediately cooled by pressing against a cool metal plate.

A control sample of thirteen layers of a 1330 dtex Spectra® standard woven fabric, style 4431, coated with 20% of the above Barrday thermoplastic elastomer was pressed into a panel using the above procedure. The total Spectra® content of this panel was the same as the experimental, quasi-unidirectional panel.

The ballistic performances of the panels were determined by measuring the $V_{50}$ performance of the panels with 9 mm full metal jacketed bullets while the panels were backed by 4 inches of oil based clay. The 4431 (control) panel had a $V_{50}$ of 280 meters per second. The $V_{50}$ performance of the panel of the invention was 328 meters per second. This is a 17% increase in $V_{50}$ compared to the control panel.

EXAMPLE II

An experimental fabric was made with 1330 dtex Spectra® warp and fill yarns and 78 dtex nylon warp and fill yarns. The Spectra yarn was twisted while the nylon yarn was not twisted. The Spectra® yarn was fed into the loom from one beam while the nylon was fed from a second beam.

The different warp yarns were alternated in the fabric, i.e. a Spectra® yarn followed by a nylon yarn, repeated across the fabric. The fill yarn was also alternately Spectra® and nylon. The fabric was woven as a plain weave fabric. To reflect the difference in strength, modulus and diameter, the Spectra® yarns were unidirectional while the nylon yarns formed a crimped fabric supporting the Spectra® yarns. The count of the fabric was 16 Spectra per inch and 16 nylon yarns per inch in both the warp and fill direction. The maximum number of 1200 denier yarns that can be woven into a plain weave is 25 ends per inch. The ratio of the diameter of the encapsulating yarn to the ballistic yarn was 5.4%. The finished fabric was coated with the thermoplastic elastomer of Example I, 20% by weight, to form a prepreg. Seventeen layers of this prepreg were pressed at 250° F. (121° C.). and 230 psi for 30 minutes. The panel was cooled under pressure to 200° F. (93° C.). before the pressure was released. The resultant panel was immediately cooled by pressing against a cool metal plate. The areal density of the resulting panel closely matched the areal density of the control panel of Example I.

The ballistic performance of this panel was determined by measuring the $V_{50}$ performance of the panel with 9 mm, full metal jacketed bullets while the panel was backed by 4 inches of oil-based clay. The $V_{50}$ performance of this panel was 365 meters per second. This is a 30% increase in $V_{50}$ compared to the control sample in Example I.

EXAMPLE III

A fabric was made with 1330 dtex Spectra® warp and fill yarns and 78 dtex nylon warp and fill yarns. The Spectra® yarn was twisted while the nylon yarn was not twisted. The Spectra® yarn was fed into the loom from one beam while the nylon was fed from a second beam. The different warp yarns were alternated in the fabric, i.e. a Spectra® yarn followed by a nylon yarn, repeated across the fabric. The fill yarn was also alternately Spectra® and nylon. The fabric was woven as a plain weave fabric. To reflect the difference in strength, modulus and diameter, the Spectra® yarns were unidirectional while the nylon yarns formed a crimped fabric supporting the Spectra® yarns. The count of the fabric was 10.5 Spectra® per inch and 10.5 nylon yarns per inch in both the warp and fill direction. The maximum number of 1200 denier yarns that can be woven into a plain weave is 25 ends per inch. The ratio of the diameter of the encapsulating yarn to the ballistic yarn was 5.4%. The finished fabric was coated with the thermoplastic elastomer of Example I, 20% by weight, to form a prepreg. Twenty five layers of this prepreg were pressed at 250° F. (121° C.). and 230 psi for 30 minutes. The resultant panel was cooled under pressure to 200° F. (93° C.). before the pressure was released. The panel was immediately cooled by pressing against a cool metal plate. The areal density of the resulting panel closely matched the areal density of the control panel of Example I.

The ballistic performance of this panel was determined by measuring the $V_{50}$ performance of the panel with 9 mm full metal jacketed bullets while the panel was backed by 4 inches of oil-based clay. The $V_{50}$ performance of this panel was 364 meters per second. This is a 29% increase in $V_{50}$ compared to the control sample in Example I.

EXAMPLE IV

A fabric was made with 1330 dtex Spectra® warp and fill yarns and 78 dtex nylon warp and fill yarns. The Spectra warp® yarn was twisted while the Spectra® fill yarn was not twisted. The nylon yarn was not twisted. The Spectra® yarn was fed into the loom from one beam while the nylon was fed from a second beam. The different warp yarns were alternated in the fabric i.e. a Spectra® yarn followed by a nylon yarn, repeated across the fabric. The fill yarn was also alternately Spectra® and nylon.

The fabric was woven as a plain weave fabric. To reflect the difference in strength, modulus and diameter, the Spectra® yarns were unidirectional while the nylon yarns formed a crimped fabric supporting the Spectra® yarns. The count of the fabric was 15 Spectra® per inch and 15 nylon yarns per inch in both the warp and fill direction. The finished fabric was coated with the thermoplastic elastomer of Example I, 18% by weight, to form a prepreg. Eighteen layers of this prepreg were pressed at 250° F. (121° C.). and 230 psi for 30 minutes. The panel was cooled under pressure to 200° F. (93°

C.). before the pressure was released. The resultant panel was immediately cooled by pressing against a cool metal plate.

A second control sample of thirteen layers of a 1330 dtex Spectra® fabric, style 4431, coated with 20% of the above thermoplastic elastomer was fabricated as in Example I. The total Spectra® content of this panel was the same as the experimental, quasi-unidirectional panel.

The ballistic performance of both of the panels was determined by measuring the $V_{50}$ of the panel with 9 mm full metal jacketed bullets while the panel was backed by 4 inches of oil-based clay. The $V_{50}$ performance of the control panel was 298 meters per second while the $V_{50}$ performance of the experimental panel was 364 meters per second. This is a 30% increase in $V_{50}$ compared to the control sample in Example I and a 22% increase over the control sample of this example.

EXAMPLE V

A 3000 denier Kevlar (aramid) quasi-unidirectional fabric was woven with a 70 denier nylon yarn as the stabilizing yarn. The nylon yarn was a 70 denier, 34 filament texturized dull nylon that was twisted at 2.5 turns per inch. The count of the fabric was nine Kevlar yarns per inch and nine nylon yarns per inch in both the warp and fill directions. The maximum number of 3000 denier yarns that can be woven into a plain weave is 18 ends per inch. The ratio of the diameter of the encapsulating yarn to the ballistic yarn was 2.6%. The fabric was pressed into a hard armor panel using the thermoplastic elastomer of Example 1. The resulting panel, with 0.88 pounds per square foot of yarn was shot with 9 mm bullets and had a $V_{50}$ performance that was 35 meters per second (16%) better than the best fabric woven from 3000 denier Kevlar. This comparison fabric was an 11×11 plain weave fabric. The ballistic panel weighed 0.93 pounds per square foot and was pressed with the same resin system.

EXAMPLE VI

An 840 denier aramid (Twaron) quasi-unidirectional fabric was woven with a 70 denier nylon yarn as the encapsulating yarn. The nylon yarn was a 70 denier, 34 filament, texturized, dull nylon that was twisted at 2.5 turns per inch. The picks per inch of the aramid yarn was 17. The maximum number of 840 denier yarns that can be woven into a plain weave is 34 ends per inch. The ratio of the diameter of the encapsulating yarn to the ballistic yarn was 9.4%. The fabric was layered into two sets of fabric panels each composed of 22 layers of fabric. One set of panels was not sewn while the second panel was sewn with lines of diagonal stitching spaced at 1.5 inch intervals. The sewn panel had a $V_{50}$ performance when shot by 9 mm bullets that was 80 meters (35%) greater than results of the shooting of the panel that was not sewn. This panel shot very erratically with the lowest penetration 81 meters below the $V_{50}$ of the sewn panel.

EXAMPLE VII

An 840 denier aramid (Twaron) quasi-unidirectional fabric was woven with a 70 denier nylon yarn as the encapsulating yarn. The nylon yarn was a 70 denier, 34 filament, texturized, dull nylon that was twisted at 2.5 turns per inch. The picks per inch of the aramid yarn was 17. The maximum number of 840 denier yarns that can be woven into a plain weave is 34 ends per inch. The ratio of the diameter of the encapsulating yarn to the ballistic yarn was 9.4%. Two layers of the finished fabric were laminated together using the thermoplastic elastomer of Example 1. The resin weight was 36 grams per square meter. The laminated fabric was layered into two sets of fabric panels each composed of 11 layers of fabric. One set of panels was not sewn while the second panel was sewn with lines of diagonal stitching spaced at 1.5 inch intervals. The sewn panel had a $V_{50}$ performance when shot by 9 mm bullets that was 62 meters (15%) greater than results of the shooting of the panel that was not sewn.

EXAMPLE VIII

An 840 denier aramid (Twaron) quasi-unidirectional fabric was woven with a 40 denier yarn as the encapsulating yarn. The encapsulating yarn was a 40 denier polyester yarn. The picks per inch of the aramid yarn was 17. The maximum number of 840 denier yarns that can be woven into a plain weave is 34 ends per inch. The ratio of the diameter of the encapsulating yarn to the ballistic yarn was 5.4%. The fabric was sewn into two fabric panels. The panels were sewn together by a line of stitches around the perimeter of the panel. The panels had a $V_{50}$ the same as a panel fabricated from the control fabric. The areal density (weight per unit of area) of this panel was the same as the experimental panel. This coated fabric was a 27.times.27 plain weave fabric. The secant modulus of the polyester yarn at 0.2% elongation was 1777 grams per tex and a maximum strength at 3% elongation was 0.31% of the ballistic yarn.

In summary, the present invention provides, in one embodiment, a unique fabric in which unidirectional ballistic yarns are provided in at least two layers at 90°±5° to each other stabilized by encapsulating yarns of substantially lower tenacity and tensile modulus woven around the ballistic yarns. Modifications are possible within the scope of the invention.

As noted above, FIGS. 4A and 4B show additional views of the plain woven fabric 10 of the prior art. The plain woven fabric 10 includes a plurality of warp yarns 14 interwoven with a plurality of weft yarns 12.

Figure 4A:
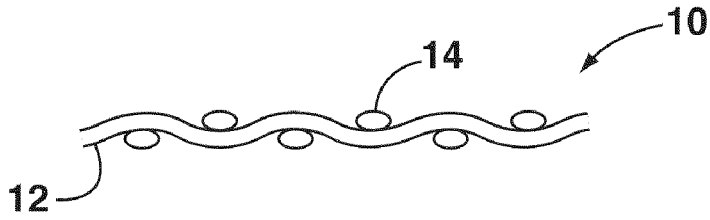
FIG. 4A (Prior Art)
FIG. 4A is a representation of a cross-section of the fabric of FIG. 1 showing an end view thereof, drawn at a larger scale.
Figure 4B:
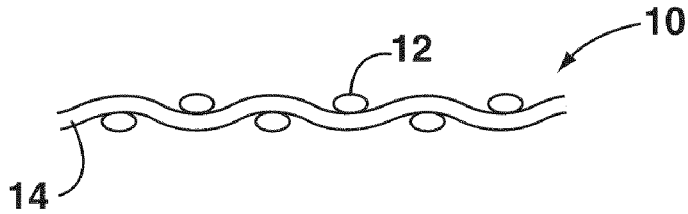
FIG. 4B (Prior Art)
FIG. 4B is a representation of a cross-section of the fabric of FIG. 1 showing a side view thereof.
Figure 4C:
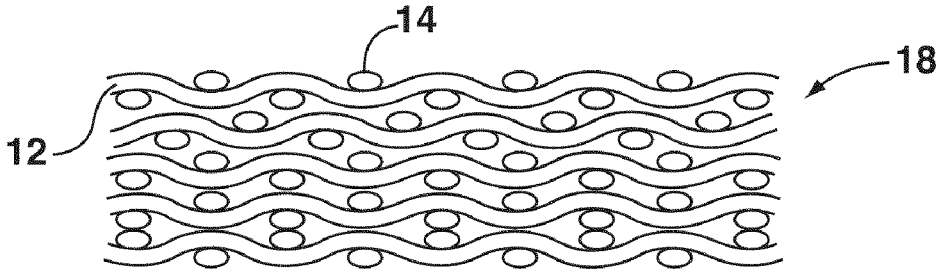
FIG. 4C (Prior Art)
FIG. 4C is a representation of a cross-section of a number of layers of the fabric of FIG. 1, arranged in an assembly and drawn at a smaller scale.
Figure 7:
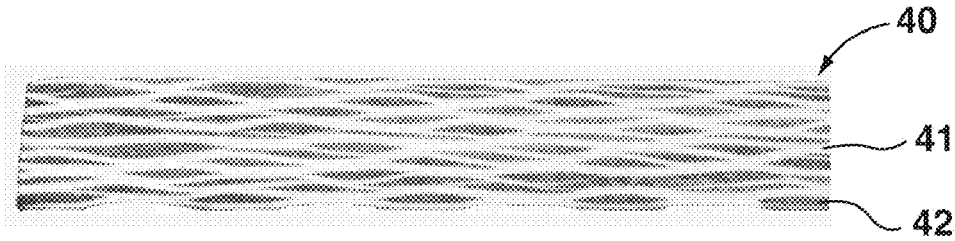
FIG. 7 is a photograph of a cross-section of a composite material including the fabric of FIG. 1, shown at a smaller scale.

FIGS. 4A and 4B disclose end views of the warp fibers 14 and the weft fibers 12 respectively. In FIG. 4C, an assembly 18 in which a number of layers of the plain woven fabric 10 are positioned in a stack is disclosed. The assembly 18 may be formed, for example, as part of the process of forming a composite material such as the composite material including the assembly 18 which is shown in FIG. 7. As described above, in known composite materials, the fabric is located in a matrix which consists of a resin (not shown in FIG. 4C) having suitable characteristics. FIG. 4C shows the condition of a number of layers of the fabric 10 after they have been subjected to heat and pressure in connection with the process of forming a composite including the layers. (The resin is not shown in FIG. 4C for clarity of illustration.) The composite may be designed, for example, for a hard armor application. As can been seen in FIG. 4C, the crimp exhibited in FIGS. 4A and 4B is repeated in each layer in the assembly 18.

Figure 5A:
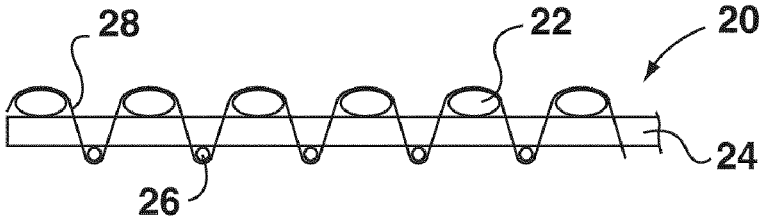
FIG. 5A is a representation of a cross-section of the fabric of FIG. 2 showing an end view thereof, drawn at a larger scale.
Figure 5B:
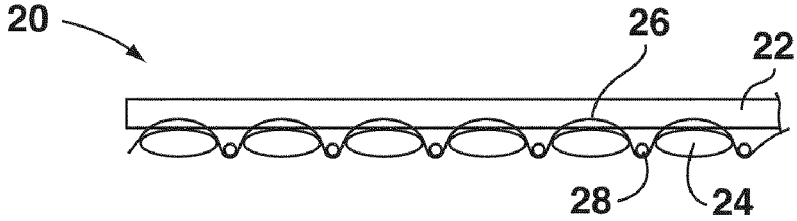
FIG. 5B is a representation of a cross-section of the fabric of FIG. 2 showing a side view thereof.
Figure 5C:
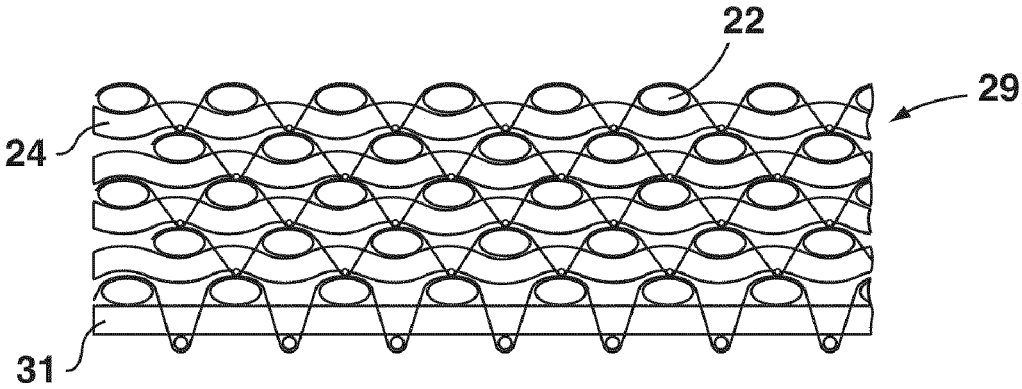
FIG. 5C is a representation of a cross-section of a number of layers of the fabric of FIG. 2, arranged in an assembly and drawn at a smaller scale.
Figure 8:
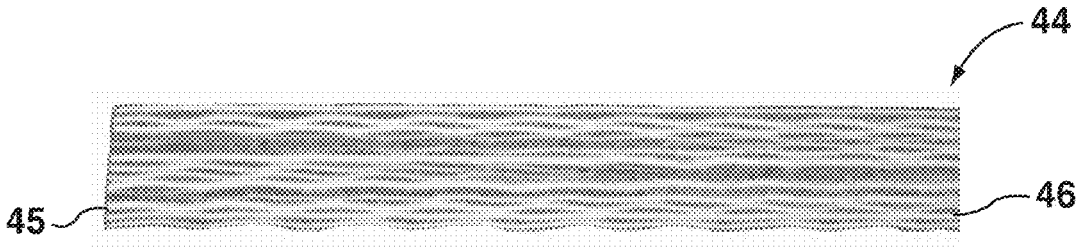
FIG. 8 is a photograph of a cross-section of another composite material including the fabric of FIG. 2.

Additional views of the fabric 20 are shown in FIGS. 5A and 5B. FIG. 5C discloses a cross-section of an embodiment of an assembly 29 consisting of a number of layers of the fabric 20. As described above, a number of layers of the material of the fabric 20 may be positioned to form a stack such as the assembly 29 in order that the assembly 29 may be included in a composite material (such as shown in FIG. 8, for example). The resin matrix is excluded from FIG. 5C for clarity of illustration. However, as illustrated in FIG. 5C, the weft fibers 24 (and also the warp fibers 22) are bent (or "crimped") to a significant extent, i.e., crimp is induced in the ballistic yarns, due to the heat and pressure which is applied to the assembly during the manufacture of the composite panel. This is a function of the voids inherent in the greige fabric 20 prior to the fabric being pressed into a composite panel. As shown in FIG. 5C, a bottom weft layer 31 of the assembly 29 is not crimped, due to its position at the bottom of the assembly 29.

Figure 6A:
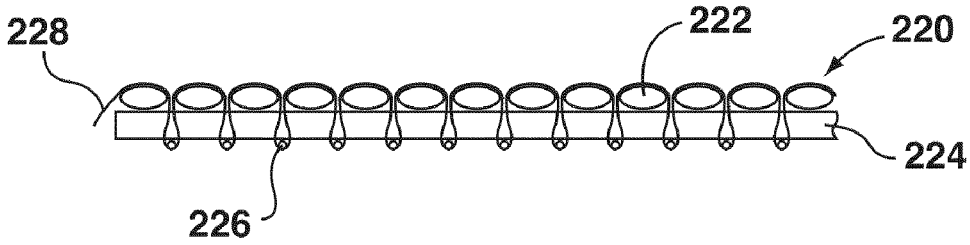
FIG. 6A is a representation of a cross-section of an alternative embodiment of the fabric of the invention showing an end view thereof, drawn at a larger scale.
Figure 6B:
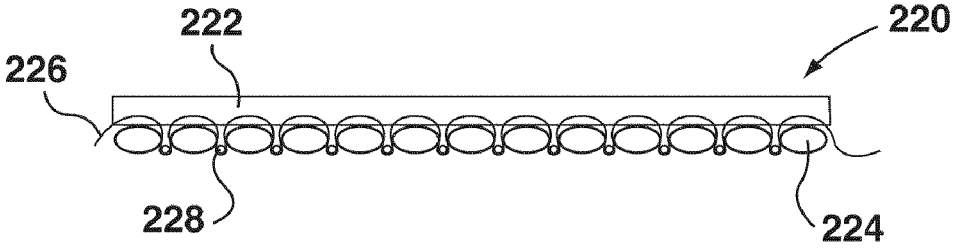
FIG. 6B is a representation of a cross-section of the fabric of FIG. 6A showing a side view thereof.

Another embodiment of the fabric of the invention designated generally by the numeral 220 is disclosed in FIGS. 6A and 6B. The fabric 220 includes unidirectional warp yarns 222 and unidirectional fill (or weft) yarns 224. Also, encapsulating warp yarns 226 and encapsulating fill yarns 228 are woven among the ballistic yarns 222 and 224 to form the fabric 220.

Figure 6C:
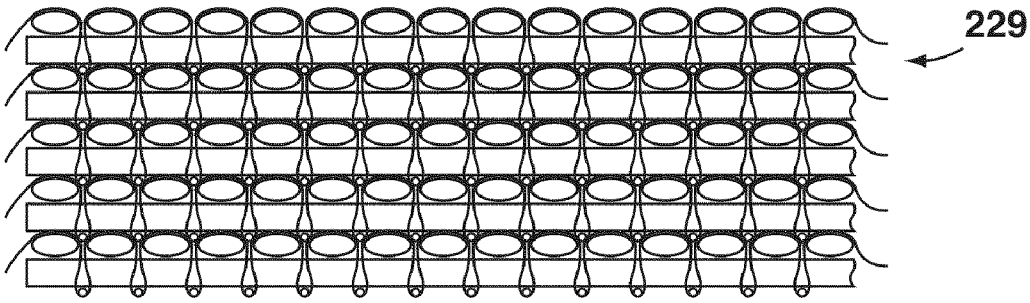
FIG. 6C is a representation of a cross-section of a number of layers of the fabric of FIG. 6A, arranged in an assembly and drawn at a smaller scale.
Figure 9:
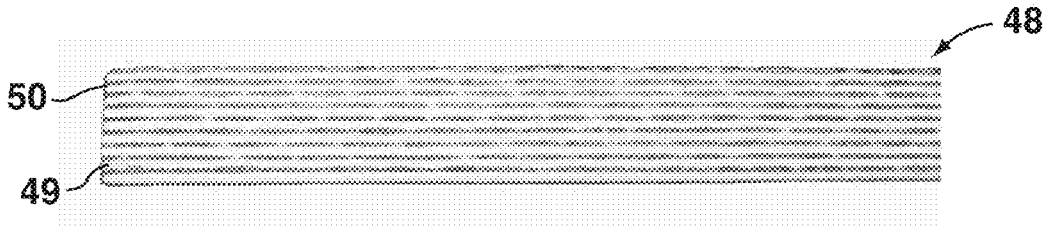
FIG. 9 is a photograph of a cross-section of an embodiment of a composite material of the invention including the fabric of FIGS. 6A, 6B, and 6C.

An assembly of a plurality of layers of the fabric 220 is disclosed in FIG. 6C. The assembly 229, as shown in FIG. 6C, illustrates the condition of a number of layers of the fabric 220 after they have been subjected to heat and pressure, as part of the process of forming a composite material (not shown in FIG. 6C). For clarity of illustration, the resin matrix is not shown in FIG. 6C. A composite material including the fabric 220 is shown in FIG. 9.

The difference between the fabrics 20 and 220 lies in the cover factors thereof respectively. As indicated above, in one embodiment, the fabric 20 has a cover factor of approximately 0.50, and generally not exceeding approximately 0.55 in any event. This upper limit was determined for soft armor applications using Kevlar® quasi-unidirectional construction and in hard armor applications using high molecular weight polyethylene where yarn spreading was determined to be beneficial to improving ballistic performance. However, the embodiment of the fabric 220 has a much higher cover factor, namely, a cover factor between approximately 0.75 and approximately 1.25, or possibly greater. A cover factor greater than 1.00 is possible because of the construction of the fabric of the invention, and in particular, because of the relatively small diameter of the encapsulating yarn relative to the ballistic yarn.

Preferably, the ballistic yarn used is any high performance ballistic yarn. For example, the ballistic yarn may be dense glass yarn, polymeric high performance yarn (e.g., ballistic aramid yarn), or basalt yarn. The encapsulating yarn in the densely woven quasi-unidirectional fabric can be natural fibers or synthetic fibers, as described above regarding the quasi-unidirectional fabric 20. In particular, the synthetic fibers preferably are regenerated cellulose, rayon, polynosic rayon, cellulose esters, acrylics, modacrylics, polyamides, polyolefins, polyester, synthetic rubber, or saran.

In a densely woven quasi-unidirectional fabric, the ratio of the diameter of the encapsulating yarn to the diameter of the ballistic yarn preferably should be as low as possible (everything else being equal) to allow for tight packing of the parallel ballistic yarns. In principle, the smaller the diameter of the encapsulating yarn and/or the more deformable the encapsulating yarn is, the less potential there is for the encapsulating yarn either to constrain or to impart crimp into the ballistic yarns—thereby adversely affecting ballistic performance.

In practice, weaving quasi-unidirectional fabric with a cover factor greater than 1.00 on standard looms is extremely difficult to achieve due to mechanical abrasion of the yarns during the weaving process. Weaving becomes progressively more difficult with increases in cover factor. Depending on a number of factors (e.g., type of ballistic yarn, type of encapsulating yarn, fabric pattern), quasi-unidirectional fabric constructions may in practice be mechanically unweavable at cover factors greater than about 1.50. At cover factors greater than 1.50 the beat-up action of the loom's reed on both the warp and fill yarns would likely result in significant yarn filament breakage. This lowers the tensile strength of the yarn, and consequently the fabric's energy absorbing potential. Filament breakage also often results in loom "smashes"—seriously damaging both the loom and the fabric.

FIG. 7 is a photograph of a cross-section of a composite 40 in which the fabric is the plain weave fabric 10. The fabric in the composite shown in FIG. 7 has a cover factor of approximately 0.51. The ballistic yarn is S-2 Glass®, and the resin is a phenolic resin at 20% by weight. The encapsulating yarns are a low modulus thermoplastic. As can be seen in FIG. 7, when the fabric 10 is included in the composite 40, a significant amount of ballistic yarn crimp is exhibited by the fabric, as described above in FIG. 4C. This crimp is inherent in the plain woven fabric and is generally not affected by the pressing process. As can be seen in FIG. 7, ballistic yarn 41 of the fabric 10 has a generally undulating profile. The dark pockets 42 defined by undulations in the yarn 41 are dispersed throughout the composite material 40. The dark pockets in FIG. 7 indicate the presence of ballistic fill yarns running substantially perpendicular to the warp yarns, and resin that has filled any voids.

FIG. 8 is a photograph of a cross-section of a composite 44 in which the fabric is the quasi-unidirectional fabric 20, with a cover factor of approximately 0.50. The ballistic yarn is S-2 Glass®, and the resin is a phenolic resin, as is known in the art. The encapsulating yarns are a low modulus thermoplastic. As can be seen in FIG. 8, the fabric 20, as included in the composite 44, has a significant amount of ballistic yarn crimp which was induced into the fabric in the pressing process. As can been seen in FIGS. 7 and 8, this level of crimp is less than the crimp in the plain woven fabric 10, but is nevertheless significant. As shown in FIG. 8, ballistic yarn 45 of the fabric 20 has an undulating profile which is generally somewhat flatter than the profile of the yarn 41 shown in FIG. 7. Also, the composite material 44 includes dark pockets 46 indicating the presence of ballistic fill yarns running substantially perpendicular to the warp yarns, and resin that has filled any voids.

In contrast to the samples shown in FIGS. 7 and 8, the fabric 220 in a composite material 48 shown in FIG. 9 exhibits virtually no ballistic yarn crimp. The densely woven construction has forced substantially all of the crimp into the encapsulating yarns which become unnecessary and parasitic once the fabric is positioned in the resin system. In this context, the purpose of the encapsulating yarns is to hold the fabric construction together until it can be formed into a composite panel. After the fabric has been included in a composite panel, the encapsulating yarns are redundant, and potentially detrimental to ballistic performance.

It appears that, in certain circumstances, the encapsulating yarns melt, dissolve, or are weakened as a result of the fabric finishing or pressing conditions in forming the composite panel. For instance, the encapsulating yarns may melt (in whole or in part) due to the application of heat. Alternatively, or in addition, the encapsulating yarns may dissolve (in whole or in part) or at least weaken somewhat due to a reaction of the encapsulating yarns with the resin or the resin system. The resin system includes any solvents present and used in conjunction with the resin. For the purposes hereof, the melting, weakening, or dissolving of encapsulating yarns is generally referred to as "deterioration", and encapsulating yarns that have so melted, weakened or dissolved are said to have "deteriorated". The deterioration of encapsulating yarns may be beneficial because the greater the extent of deterioration, the less likely it is that the encapsulating yarns may constrain or crimp the ballistic resistant yarns in a ballistic event.

As can be seen in FIG. 9, in the composite system 48, the densely woven quasi-unidirectional fabric construction 220 remains substantially crimp-free, even though it has been compressed under high pressure. The fabric 220 in the composite 44 shown in FIG. 9 has a cover factor of approximately 0.89. The ballistic yarn is S-2 Glass®, and the resin is a phenolic resin, as is known in the art. The encapsulating yarns are a low modulus thermoplastic. As shown in FIG. 9, ballistic yarn 49 of the fabric 220 is substantially flat, i.e., substantially crimp-free. The composite material 48 includes substantially linear layers 50 between the yarns 49 primarily consisting of ballistic fill yarns running substantially perpendicular to the ballistic warp yarns 49 in a resin matrix.

Because the fabric 220 is substantially crimp-free, the following benefits result.

(a) The ballistic yarns in the fabric 220 are better able to permit the propagation of longitudinal tensile waves along the ballistic yarn axis during a ballistic event. As described above, any crimp in the ballistic yarn may act as a point at which the tensile wave would be reflected, which adds to the total tensile load acting on the yarn. Because of this, crimp in the ballistic yarn causes the ballistic yarn to break before the maximum amount of energy can be absorbed along the ballistic yarn's length.

(b) The ballistic yarns in the fabric 220 undergo tensile stress immediately upon impact by a projectile. This maximizes the number of ballistic yarns that act on the projectile upon impact. Also, in the case of a deformable projectile, the fast response of the ballistic yarns encourages the rapid deformation of the projectile. Deformation of the projectile serves to dissipate energy and, at the same time, to increase the diameter of the projectile. The number of yarns which act on a projectile is directly proportional to the square of the projectile diameter. Therefore, a change in the diameter of the projectile is an important factor affecting the behavior of the fabric during a ballistic event.

To form a composite material, fabric (preferably, a fabric assembly consisting of many layers of fabric) is surrounded and impregnated by a resin (e.g., a thermoset or thermoplastic resin). As indicated above, in connection with the process of forming a composite, the fabric to be included in the composite is subjected to heat and pressure. The densely woven quasi-unidirectional fabric construction 220 remains crimp-free even after it has been subjected to heat and pressure in the formation of a composite because the tightly packed ballistic yarns in the fabric make up continuous (or substantially continuous) unidirectional sheets which are substantially without voids, or at least define relatively small voids. As can be seen in FIGS. 4A, 4B, 4C, 5A, 5B, 5C, 6A, 6B, and 6C, voids between ballistic yarns result in fiber distortion and/or crimp when the fabric is subjected to heat and pressure in the formation of a composite.

The fabric 220 of the invention is further illustrated by the following additional Examples. In the following Examples, the different sample fabrics were woven to evaluate the impact of fabric construction on the ballistic performance of rigid glass composite panels against different ballistic threats.

EXAMPLE IX

Three different fabrics were made using 20330 dtex S-2 Glass® (AGY's 463-AAA-250 S-2 Glass® assembled roving) as the ballistic yarn. The first fabric was a quasi-unidirectional fabric with a cover factor of about 0.50. This fabric had 4.5, S-2 Glass® ballistic yarns per inch and 4.5 nylon (78 dtex, 34 filament texturized, dull nylon with 2.5 TPI of yarn twist) encapsulating yarns per inch in both the warp and fill directions. The second fabric was a densely woven quasi-unidirectional fabric, with a cover factor of about 0.89. This fabric had 8.0, S-2 Glass® ballistic yarns per inch and 8.0 nylon encapsulating yarns per inch in both the warp and fill directions. Finally, the third fabric was plain woven S-2 Glass® fabric with a cover factor of 0.51. This plain woven fabric had 5, S-2 Glass® ballistic yarns per inch in both the warp and fill directions and is commonly used in vehicle armor applications. Each of these respective fabrics was dip-coated with the same vinyl ester, thermoset resin to give a prepreg fabric with 20% resin by weight. Multiple layers of each fabric sample were then pressed at 240° F. (115.6° C.) at 390 psi to create rigid composite panels of S-2 Glass® in a vinyl ester matrix. Each panel was cooled under pressure to 180° F. (82.2° C.) and had an areal density of approximately 5.2 lbs./ft.$^2$ The ballistic performance was determined by measuring the $V_{50}$ of the three composite systems with 0.50 caliber FSP (fragment simulating projectiles). Each panel was tested as per MIL-STD-662F (Dept. of Defence Test Method Standard, $V_{50}$ Ballistic Test for Armor) where a 0.5 mm thick sheet of 2024-T3 aluminium alloy was used as a witness plate behind the armor being tested.

Figure 10A:
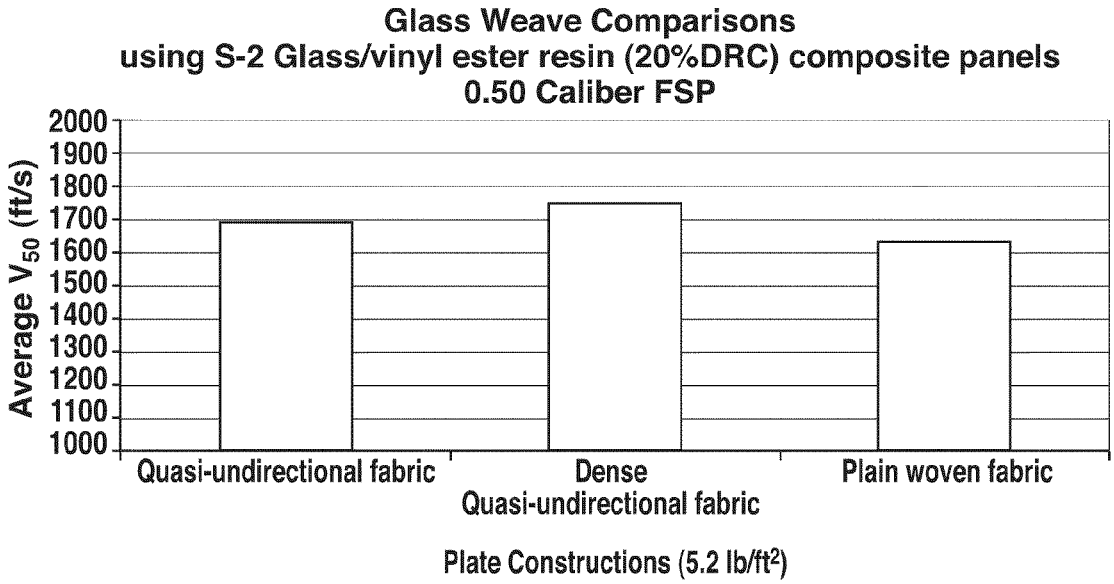
FIG. 10A is a graph showing the ballistic performance of a variety of samples of fabric, as described below.

As can be seen in FIG. 10A, the densely woven quasi-unidirectional fabric provided the best results, with an average $V_{50}$ of 1748 ft./second (533 m/s). The composite system with the other quasi-unidirectional fabric had an average $V_{50}$ of 1692 ft./second (515 m/s), and the composite system including the plain woven fabric had an average $V_{50}$ of 1633 ft./second (498 m/s).

EXAMPLE X

The fabric constructions used in Example IX were reproduced. A phenolic resin commonly used in commercial composite vehicle armor was used instead of the vinyl ester previously used.

Each of the respective fabrics was dip-coated with a phenolic, thermoset resin to produce prepreged fabrics with 20% resin by weight. Multiple layers of each fabric sample was then compression-molded into rigid plates as per a compression moulding protocol designed by AGY (Advanced Glass Yarns Inc.) to produce S-2 Glass®, HJ1 ballistic panels. Molding temperatures reached a high of 345° F. (174° C.) and pressures of approximately 150 psi in creating these rigid composite panels of S-2 Glass® in a phenolic resin matrix. Each panel was cooled under pressure to 180° F. (82.2° C.) and had an areal density of approximately 3.0 lbs./ft.$^2$ Each panel was tested as per MIL-STD-662F against 44 Mag (240 gr) lead swc gas checked ammunition.

Figure 10B:
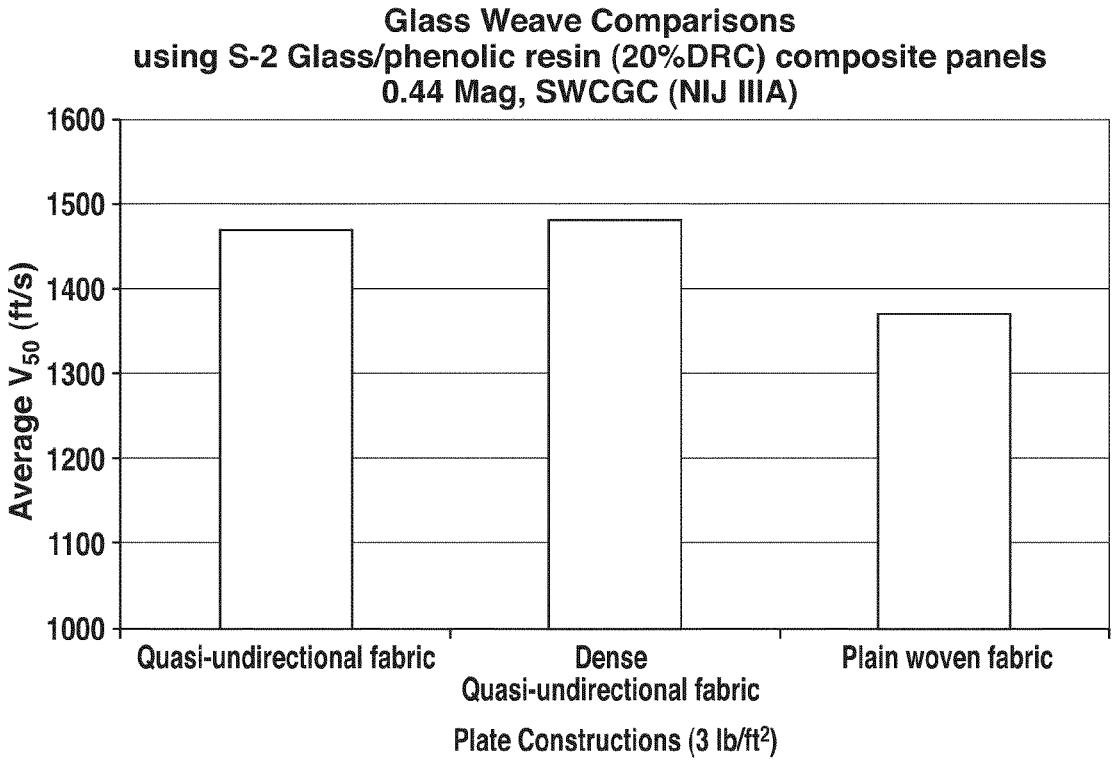
FIG. 10B is a graph showing the ballistic performance of a variety of samples of fabric, as described below.

As can be seen in FIG. 10B, the densely woven quasi-unidirectional fabric provided the best results, with an average $V_{50}$ of 1,483 ft./second (452 m/s). The composite system with the other quasi-unidirectional fabric had an average $V_{50}$ of 1,473 ft./second (449 m/s), and the composite system including the plain woven fabric had an average $V_{50}$ of 1,371 ft./second (418 m/s).

EXAMPLE XI

The fabric constructions used in Examples IX and X were included in three composite systems respectively in which the resin was a phenolic resin. Each of the three fabric constructions was tested as an approximately 5.4 lbs./ft.$^2$ areal density flat panel in a rigid phenolic resin matrix. The ballistic performance was determined by measuring the $V_{50}$ of the three composite systems with 0.50 caliber non-deformable fragment simulating projectiles. Each panel was tested as per MIL-STD-662F against 44 Mag (240 gr) lead swc gas checked ammunition.

Figure 10C:
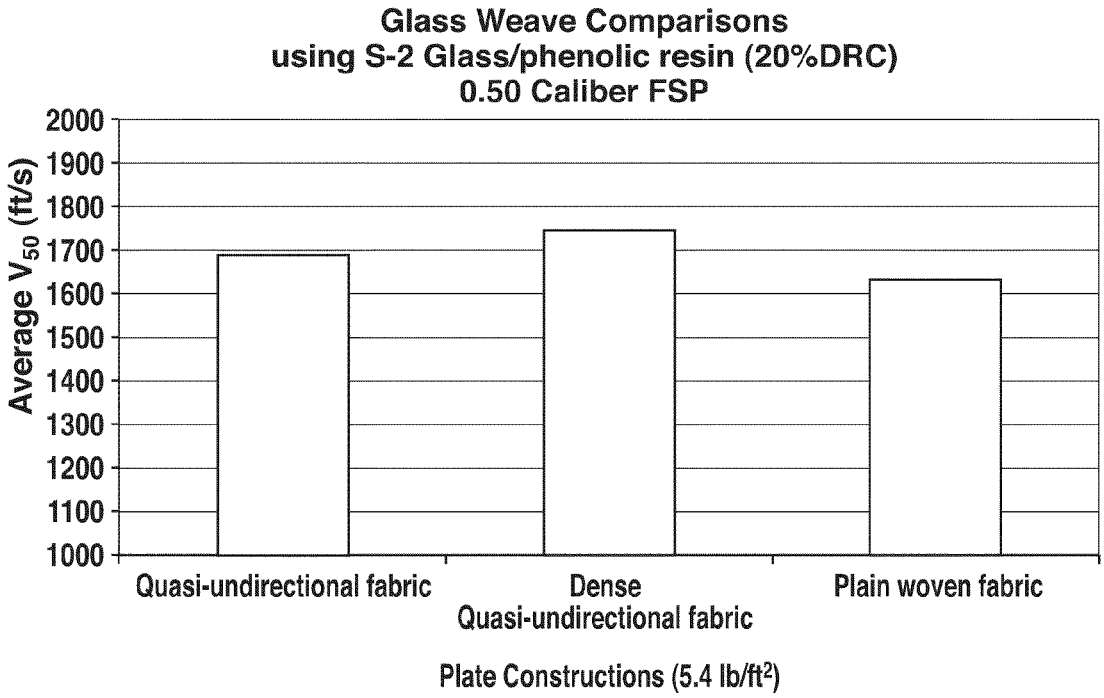
FIG. 10C is a graph showing the ballistic performance of a variety of samples of fabric, as described below.

As shown in FIG. 10C, the densely woven quasi-unidirectional fabric provided the best results, with an average $V_{50}$ of 1,748 ft./sec. (533 m./sec.). The composite system with the other quasi-unidirectional fabric had an average $V_{50}$ of 1,692 ft./sec. (516 m./sec.) and the composite system with the plain woven fabric had an average $V_{50}$ of 1,633 ft./sec. (498 m./sec.).

EXAMPLE XII

The fabric constructions used in Examples IX-XI were reproduced. Each of the three fabric constructions was tested as an approximately 10.4 lbs./ft.$^2$ areal density flat panel in a rigid vinyl ester resin. The ballistic performance was determined by measuring the $V_{50}$ of the three composite systems with 0.30 caliber high velocity rifle rounds. Each panel was tested as per MIL-STD-662F against 7.62×51 mm. (150 gr) NATO M80 ball ammunition. Each panel was tested to determine the relative performance to one another and to determine if the armor panels would likely meet NIJ 0108-.01 level III armor specifications.

Figure 10D:
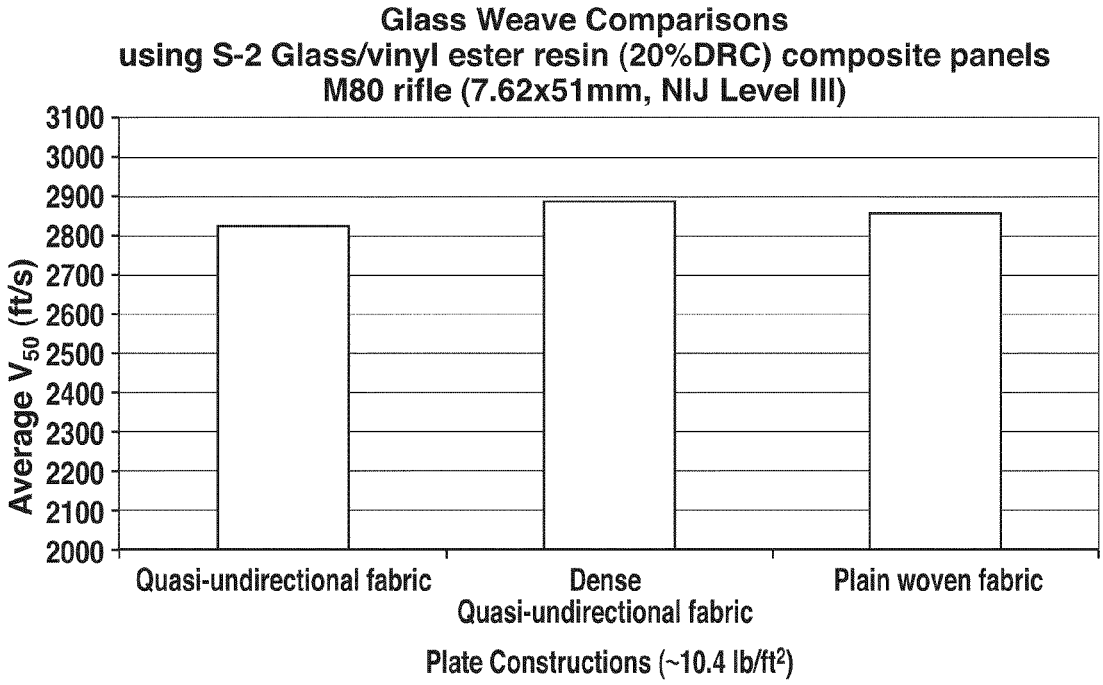
FIG. 10D is a graph showing the ballistic performance of a variety of samples of fabric, as described below.

As shown in FIG. 10D, the densely woven quasi-unidirectional fabric provided the best results, with an average $V_{50}$ of 2,890 ft./sec. (881 m/sec.). The composite system with the other quasi-unidirectional fabric had an average $V_{50}$ of 2,826 ft./sec. (861 m./sec.) and the plain woven fabric had an average $V_{50}$ of 2,857 ft./sec. (871 m./sec.).

It is believed that hard armor composite systems constructed primarily from dense glass fibers (e.g., dense glass fibers sold under the trademarks S-2 Glass® or E-glass) have a significantly different failure mechanism to that of composite systems constructed primarily from high-performance polymeric aramid fibers (e.g., aramid fibers sold under the trademarks Kevlar® and Twaron®) or HMWPE yarns (e.g., Spectra®, Dyneema®). It is also believed that, because of this different failure mechanism, the negative effects of constraining the ballistic yarns (i.e., the reflection of longitudinal strain waves) are minimized in densely woven glass composites and hence do not necessarily adversely affect ballistic performance. It is postulated that due to high relative density of glass yarns (specific gravity of S-2 Glass® is 2.48, and the specific gravity of E-glass is 2.54) to polymeric high performance yarns (specific gravity of aramid yarns is 1.44, and the specific gravity of HMWPE is 0.98) its ballistic performance is not as dependent on its ability to rapidly disperse strain waves away from the impact point. Rather for glass yarns its ballistic performance is much more a function of its tensile strength, modulus and its high strain-to-failure (e.g., S-2 Glass® yarn has an approximate 5.3% to 5.7% elongation to break, and ballistic aramid yarn typically has an elongation to break of approximately 2.1% to 3.5%). This difference in failure mechanisms is clearly demonstrated by the fact that, unlike aramid fabrics, woven glass fabrics have very poor ballistic properties unless they are encapsulated in a rigid, typically thermo-setting, resin system.

Based on the foregoing, it appears that a densely woven quasi-directional fabric with dense glass yarns and having a cover factor between approximately 0.75 and approximately 1.50 provides improved ballistic performance when included in a composite panel with a rigid matrix. Preferably, the cover factor is between approximately 0.75 and approximately 1.25.

It has been found that small, non-deformable, high-velocity projectiles can essentially slip through lower cover factor fabric constructions used in hard armor helmet applications. The geometry and size of such non-deformable projectiles makes them easier to consistently defeat with a densely woven quasi-unidirectional fabric construction.

This phenomenon of the projectile pushing aside yarn bundles (where relatively lower cover factor fabric is used), rather that impacting them, is a particular problem when constructing ballistic helmets out of large denier (e.g. 1500 denier, or 3000 denier) aramid yarns. In such constructions, it is typical that the resin contents are intentionally kept low (e.g. typically from 10 to 20% compared to standard composites at 40 to 60% resin content) as the resin serves only to give rigidity to the helmet and does not act a stress transfer medium in the same way as it would in conventional composites under low speed loading. In fact, what the resin (whether thermoset or thermoplastic) typically does is to bond yarn crossovers causing greater stress concentrations, from the reflection of strain waves, which ultimately leads to premature yarn failure and consequently a lower performing ballistic helmet. Accordingly, to mitigate this failure mechanism and also to lower the overall weight of a helmet, designers frequently use the bare minimum of resin when working with aramids to give the yarn maximum freedom of movement. Maximum freedom of movement allows the fibers to absorb energy through strain failure and also through the delamination of individual fabric layers during a ballistic event. A significant problem with this, however, is that providing for more freedom of yarn movement also increases the statistical probability of small, fast moving projectiles pushing aside, rather than impacting, the ballistic yarns.

This is a growing concern especially for military as soldiers are increasingly threatened by improvised explosive devices (IED's) which generate a large number of small fast moving fragments. In response to this growing threat, new military helmet performance specifications typically require that helmets to meet a number of stringent small fragment performance criteria as outlined in Table I below.

TABLE I

Minimum $V_{50}$ Ballistic Limits

| Projectile | Minimum $V_{50}$ at 0° obliquity (ft/sec) |
|---|---|
| 2-grain Right Circular Cylinder (RCC) | 4075 |
| 4-grain RCC | 3450 |
| 16-grain RCC | 2425 |
| 17-grain Fragment Simulating Projectile | 2200 |

Of the fragments listed in Table I, the 2-grain and the 4-grain often prove to be the most difficult to stop consistently as fabric-based composite armors, by their very nature, have a high level of performance variability, as compared to, e.g., steel or aluminum. For example, a fabric-based hard composite armor with the same minimum $V_{50}$ ballistic protection limit as an aluminum plate would typically have a standard deviation of approx 3 times that of the aluminum (i.e., 150 ft/sec as compared to 50 ft/sec). Hence, while on average they have the same fragment stopping potential, the probability of a fragment penetrating the composite armor at a velocity less than its minimum $V_{50}$ ballistic limit is much greater.

This performance variability in ballistic armor is often referenced as the armor's "zone of mixed results" (ZOM) and is typically much greater for small fragments due to the phenomenon of projectile slip-thorough discussed above. (The ZOM for a particular sample can be defined as the difference between the highest velocity shot that did not penetrate the sample and the lowest velocity shot that did penetrate). This phenomenon can be minimized through the use of small denier, tightly woven (i.e., high-crimp fabrics). However, small denier aramids (e.g., 200 to 850 denier) are considerably more expensive, making them cost prohibitive. Also, high levels of crimp have been demonstrated to reduce ballistic performance.

Densely woven quasi-unidirectional fabric constructions offer a good solution to this problem in ballistic helmets because the fabric constructions, at 0.75 to 1.25 cover factor, are tight enough to prevent 2-grain and 4 grain RCC projectiles from periodically squeezing through gaps between ballistic yarns. This lowers the effective zone of mixed results of the composite armor. In addition, these fabric constructions allow for the use of lower-cost, large denier aramid yarns in manufacture of fabrics for helmet applications—effectively lowering the material cost of the helmet. Also, there are no ballistic yarn crossover points, thus allowing longitudinal strain waves to rapidly disperse from the impact point.

EXAMPLE XIII

The following table shows a comparison of the $V_{50}$ performance of two densely woven, quasi-unidirectional fabrics including Kevlar® yarns compared to a plain woven Kevlar® fabric when tested against high velocity non-deformable fragments (i.e., 2-grain right circular cylinders). These panels were all pressed at approximately 1.95 lb/ft2 areal density, typical of a standard high-performance helmet shell, using the same PVB-phenolic resin system. It should also be noted that both densely woven, quasi-unidirectional constructions were manufactured using 1420 denier Kevlar® K129 yarn which typically would give lower $V_{50}$ results than an equivalent 850 denier Kevlar KM2 fabric. This is due to both the size and property differences between the yarns. 850 denier Kevlar® is also considerably more expensive than 1420 denier Kevlar® K129 yarn.

TABLE II

Relative Ballistic Performance of Aramid Fabric Constructions vs. 2-grain RCC Projectiles

| Yarn | Sample # | Fabric Description | Cover Factor | Resin System | # of layers | 2gn RCC, Avg. $V_{50}$ (ft/sec) |
|---|---|---|---|---|---|---|
| Kevlar ® 1420 denier, K129 | RKV4485-4695 | Dense quasi-unidirectional fabric, 17 × 17 | 0.80 | PVB/Phenolic | 38 | 4040 |
| Kevlar ® 1420 denier, K129 | RKV4485-5265 | Dense quasi-unidirectional fabric, 20 × 20 | 0.94 | PVB/Phenolic | 32 | 3928 |
| Kevlar ® 850 denier, KM2 | RAR4007-2691 | Plain woven fabric, 31 × 31 | 0.90 | PVB/Phenolic | 35 | 3733 |

As can be seen from Table II, both densely woven quasi-unidirectional constructions outperformed the 850 denier Kevlar KM2 construction against this particular threat. However, it appears from the foregoing that the fabric construction would provide acceptable ballistic performance with the ballistic yarns over a wide range of linear densities, e.g., between approximately 400 denier and approximately 3000 denier. It also appears that the cover factor preferably is between approximately 0.75 and approximately 1.50, and more preferably between approximately 0.80 and approximately 1.05.

Figure 11:
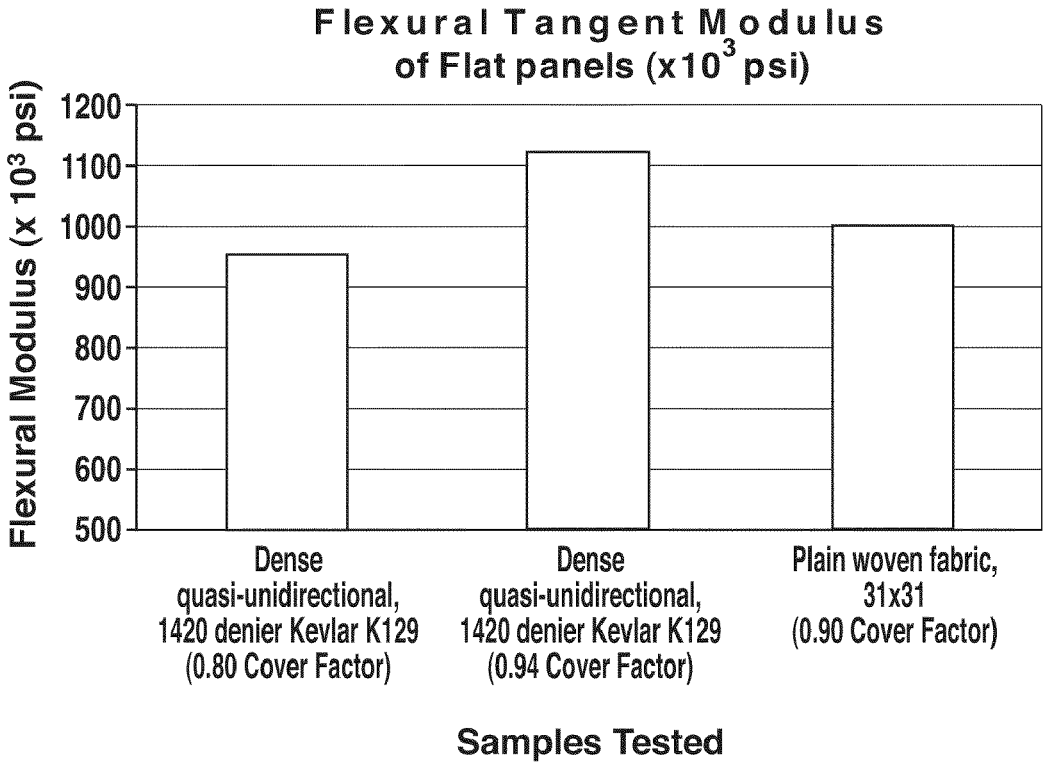
FIG. 11 is a graph showing tangential modules values for certain samples of fabric, as described below.

Each of the panels tested and referred to in Table II and FIG. 11 had an approximate areal density of 1.95 lb./ft.$^2$. The panels were made specifically to approximate the thickness of a typical military helmet molded out of Kevlar® fabric. In each sample, the resin system was PVB-phenolic. All the plates were pressed under the same pressing conditions, namely: temperature was 310° F.; pressure was 150 psi; time was 30 minutes; and the plates were cooled to 180° F. The test specimens for the three-point bend test (described below) were cut using a water jet.

The densely woven unidirectional fabric is inherently very rigid and consequently may require less resin than standard woven fabrics to meet minimum helmet structural requirements (i.e., compression and impact resistance). FIG. 11 is a comparison of the flexural tangent moduli of the composite panels referred to in Table II, namely, a composite panel including plain woven, 850 denier Kevlar® KM2 fabric having a cover factor of approximately 0.90; a composite panel including densely woven quasi-unidirectional fabric, 1420 denier Kevlar® K129, having a cover factor of approximately 0.94; and a composite panel including densely woven quasi-unidirectional fabric, 1420 denier Kevlar 129®, having a cover factor of approximately 0.80. As can be seen from FIG. 11, the densely woven quasi-unidirectional construction was more rigid (i.e., had higher tangential modulus values). The flexural tangent modulus in each case was determined by means of a three-point bending test in accordance with ASTM D790-03 (Flexural Properties of Unreinforced and Reinforced Plastics and Electrical Insulating Materials).

The benefits of using the densely woven fabric including 1420 denier Kevlar® 190 for this particular threat (i.e., small high velocity non-deformable fragments), as compared to the quasi-unidirectional fabric, are as follows.

(a) The densely woven fabrics allow for the use of lower-cost, large denier aramid yarns in manufacture of fabrics for helmet applications, thereby effectively lowering the material cost of the helmet, because lower denier aramid yarns are relatively expensive.

(b) There are no ballistic yarn crossover points, thus allowing longitudinal strain waves to rapidly disperse from the impact point.

(c) The densely woven unidirectional fabric is inherently very rigid and consequently may require less resin than standard woven fabrics to meet minimum helmet structural requirements (i.e., compression and impact resistance). As can be seen from FIG. 11, the dense quasi-unidirectional construction is shown to be more rigid (i.e., had higher tangential modulus values).

Although the foregoing discussion has been focused on ballistic aramid yarn, other polymeric high performance yarns would provide similar results.

Any element in a claim that does not explicitly state "means for" performing a specific function, or "step for" performing a specific function, is not to be interpreted as a "means" or "step" clause as specified in 35 U.S.C. §112, paragraph 6.

It will be appreciated by those skilled in the art that the invention can take many forms, and that such forms are within the scope of the invention as claimed. Therefore, the spirit and scope of the appended claims should not be limited to the descriptions of the preferred versions contained herein.

We claim:

1. A woven fabric included in a panel for protecting against a ballistic threat, the fabric comprising:

a first layer of high-performance unidirectional yarns;

a second layer of high-performance unidirectional yarns disposed transversely to the first layer;

warp and fill encapsulating yarns woven around the unidirectional yarns to substantially stabilize the unidirectional yarns, said encapsulating yarns having tenacities and tensile moduli substantially less than the tenacities and tensile moduli of the unidirectional yarns; and the fabric having a cover factor between approximately 0.75 and approximately 1.50 such that the yarns in the first and second layers, as included in the panel, are substantially crimp-free.

2. A single ply woven fabric included in a panel for protecting against a ballistic threat, the fabric comprising unidirectional ballistic resistant yarns in at least two layers in the single ply, the layers being at 90°±5° with respect to each other, the ballistic resistant yarns being substantially stabilized by being woven with encapsulating yarns having substantially lower tenacity and tensile modulus than the ballistic resistant yarns and the fabric having a cover factor between approximately 0.75 and approximately 1.50 such that the yarns in the first and second layers, as included in the panel, are substantially crimp-free.

3. A woven fabric according to claim 2 in which the cover factor is between approximately 0.75 and approximately 1.25.

4. A woven fabric according to claim 2 in which the ballistic yarn is a high performance ballistic resistant yarn.

5. A woven fabric according to claim 4 in which the high performance ballistic yarn comprises dense glass fibers.

6. A woven fabric according to claim 5 having a cover factor of approximately 0.89.

7. A woven composite material comprising multiple layers of the fabric of claim 5.

8. A composite material according to claim 7 comprising a thermoset resin impregnating the woven fabric.

9. A composite material according to claim 7 in which the encapsulating yarns have substantially deteriorated due to the process of forming the composite material.

10. A woven fabric according to claim 4 in which the high performance ballistic yarn comprises polymeric high performance yarn.

11. A woven fabric according to claim 10 in which the polymeric high performance yarns have a linear density between approximately 400 denier and approximately 3000 denier.

12. A woven fabric according to claim 10 having a cover factor between approximately 0.80 and approximately 1.05.

13. A composite material comprising multiple layers of the woven fabric of claim 10.

14. A woven fabric according to claim 4 in which the encapsulating yarns have a denier between approximately 20 and approximately 1000.

15. A woven fabric according to claim 4 in which the encapsulating yarns are selected from the group consisting of natural fibers and synthetic fibers.

16. A woven fabric according to claim 15 in which said synthetic fibers are elected from the group consisting of regenerated cellulose, rayon, polynosic rayon, cellulose esters, acrylics, modacrylics, polyamides, polyolefins, polyester, synthetic rubber, and saran.

17. A woven fabric according to claim 2 in which the ballistic resistant yarn has a tenacity of at least about 15 grams per denier and a tensile modulus of at least about 400 grams per denier.

18. A woven fabric according to claim 2 in which the ballistic resistant yarn is selected from the group consisting of glass yarn, polymeric high performance yarn, and basalt yarn.

19. A ballistic resistant fabric assembly comprising multiple layers of the woven fabric of claim 2.

20. A composite material comprising the ballistic resistant fabric of claim 2.

21. A method of forming a woven fabric included in a panel for protecting against a ballistic threat, comprising:

(a) creating a single ply fabric comprising unidirectional dense glass ballistic resistant yarns in at least two layers in the single ply, the layers being at 90°±5° with respect to each other, the ballistic resistant yarns being substantially stabilized by being woven with encapsulating yarns having substantially lower tenacity and tensile modulus than the ballistic resistant yarns and the fabric having a cover factor between approximately 0.75 and approximately 1.25;

(b) creating a ballistic resistant fabric assembly comprising multiple layers of the single ply fabric, wherein the yarns in the layers, as included in the panel, are substantially crimp-free;

(c) immersing the ballistic resistant fabric assembly in a thermoset resin in liquid form;

(d) permitting the encapsulating yarns to substantially deteriorate due to the process of forming the composite material; and (e) curing the thermoset resin.

22. A method of forming a woven fabric included in a panel for protecting against a ballistic threat, comprising:

(a) creating a single ply fabric comprising unidirectional aramid ballistic resistant yarns in at least two layers in the single ply, the layers being at 90°±5° with respect to each other, the ballistic resistant yarns being substantially stabilized by being woven with encapsulating yams having substantially lower tenacity and tensile modulus than the ballistic resistant yarns and the fabric having a cover factor between approximately 0.80 and approximately 1.50;

(b) creating a ballistic resistant fabric assembly comprising multiple layers of the single ply fabric, wherein the yarns in the layers, as included in the panel, are substantially crimp-free;

(c) immersing the ballistic resistant fabric assembly in a liquid thermoset resin; and (d) curing the thermoset resin.

23. A woven fabric included in a panel for protecting against a ballistic threat, the fabric comprising:

a first layer of high-performance unidirectional yarns;

a second layer of high-performance unidirectional yarns disposed transversely to the first layer;

warp and fill encapsulating yarns woven around the unidirectional yarns to substantially stabilize the unidirectional yarns, said encapsulating yarns having tenacities and tensile moduli substantially less than the tenacities and tensile moduli of the unidirectional yarns; and the fabric having a cover factor between approximately 0.40 and approximately 0.84 such that the yarns in the first and second layers, as included in the panel, are substantially crimp-free.

* * * * *